US011371743B2

(12) United States Patent
Nakagawa et al.

(10) Patent No.: US 11,371,743 B2
(45) Date of Patent: Jun. 28, 2022

(54) AIR CONDITIONING SYSTEM

(71) Applicant: Daikin Industries, LTD., Osaka (JP)

(72) Inventors: Yuusuke Nakagawa, Osaka (JP); Makoto Kojima, Osaka (JP); Takuro Yamada, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 162 days.

(21) Appl. No.: 16/619,281

(22) PCT Filed: Jul. 13, 2018

(86) PCT No.: PCT/JP2018/026550
§ 371 (c)(1),
(2) Date: Dec. 4, 2019

(87) PCT Pub. No.: WO2019/017299
PCT Pub. Date: Jan. 24, 2019

(65) Prior Publication Data

US 2020/0141609 A1 May 7, 2020

(30) Foreign Application Priority Data

Jul. 20, 2017 (JP) ..... JP2017-140703

(51) Int. Cl.
*F24F 11/84* (2018.01)
*F24F 1/0007* (2019.01)

(52) U.S. Cl.
CPC ..... *F24F 11/84* (2018.01); *F24F 1/00075* (2019.02)

(58) Field of Classification Search
CPC ..... F25B 2600/2513; F25B 2313/023; F25B 2313/006; F24F 1/00075; F24F 11/84
See application file for complete search history.

(56) References Cited

U.S. PATENT DOCUMENTS

2016/0146496 A1* 5/2016 Yamashita ..... F24F 13/30 62/190

FOREIGN PATENT DOCUMENTS

EP 3 306 214 A1 4/2018
JP 2-40457 A 2/1990
(Continued)

OTHER PUBLICATIONS

Translation of JP-2000297970-A (Year: 2000).*
(Continued)

*Primary Examiner* — Schyler S Sanks
(74) *Attorney, Agent, or Firm* — Birch, Stewart, Kolasch & Birch, LLP

(57) ABSTRACT

An air conditioning system capable of reducing noise incidental to gas-liquid two-phase transfer is provided. The air conditioning system (100) performs a refrigeration cycle in a refrigerant circuit (RC) including an outdoor unit (10), a plurality of indoor units (40), and a liquid-side connection pipe (LC) connecting the outdoor unit (10) and the indoor units (40). The air conditioning system (100) includes a second outdoor control valve (17, electric valve) decompressing the refrigerant flowing in the refrigerant circuit (RC) in accordance with an opening degree, an operating-capacity variation detection portion (74, detection portion) detecting change of the number of operating units in accordance with device information, and a device control portion (75, control portion) controlling a state of the second outdoor control valve (17). The device control portion (75) executes first control (feed-forward control) when the change of the number of operating units is detected by the operating-capacity variation detection portion (74), and adjusts the opening degree of the second outdoor control valve (17) to suppress a rise of pressure of the refrigerant flowing into the operating unit.

7 Claims, 7 Drawing Sheets

(56) References Cited

FOREIGN PATENT DOCUMENTS

| | | | | |
|---|---|---|---|---|
| JP | 2000-297970 | A | | 10/2000 |
| JP | 2000297970 | A | * | 10/2000 |
| JP | 2005-147541 | A | | 6/2005 |
| JP | 2005147541 | A | * | 6/2005 |
| WO | WO 2015/029160 | A1 | | 3/2015 |
| WO | WO 2016/194098 | A1 | | 12/2016 |

OTHER PUBLICATIONS

Translation of JP-2005147541-A (Year: 2005).*
International Preliminary Report on Patentability and the Written Opinion of the International Searching Authority for International Application No. PCT/JP2018/026550, dated Jan. 30, 2020.
International Search Report for International Application No. PCT/JP2018/026550, dated Sep. 25, 2018.
Extended European Search Report for European Application No. 18835621.6, dated Feb. 23, 2021.

* cited by examiner

AIR CONDITIONING SYSTEM

TECHNICAL FIELD

The present disclosure relates to an air conditioning system.

BACKGROUND ART

An air conditioning system including an outdoor unit and a plurality of indoor units is known in the past. For example, Patent Literature 1 (International Publication No. 2015/029160) discloses an air conditioning system in which one outdoor unit and a plurality of indoor units are connected through refrigerant connection pipes. In Patent Literature 1, an expansion valve (indoor expansion valve) is disposed in each of the indoor units and a refrigerant is decompressed by the indoor expansion valve during cooling operation.

SUMMARY OF THE INVENTION

Technical Problem

In an air conditioning system, when operating states of the indoor units change significantly (namely, when the operating capacity changes significantly), a pressure of the refrigerant flowing into the indoor units under operation may rise temporarily, and therefore a decompression in the indoor expansion valve may increase, thus causing noise. The present disclosure proposes an air conditioning system reducing such noise.

Solution to Problem

An air conditioning system according to a first aspect of the present invention performs a refrigeration cycle in a refrigerant circuit. The refrigerant circuit includes an outdoor unit, a plurality of indoor units, a refrigerant connection pipe connecting the outdoor unit and the indoor units. The air conditioning system according to the first aspect includes an electric valve, a detection portion, and a control portion. The electric valve decompresses a refrigerant flowing in the refrigerant circuit in accordance with an opening degree. The detection portion detects change of the number of operating units that are the indoor units under operation. The control portion controls a state of the electric valve. The control portion executes first control when the change of the number of operating units is detected by the detection portion. The control portion adjusts the opening degree of the electric valve in the first control to suppress a rise of pressure of the refrigerant flowing into the operating unit.

In the air conditioning system according to the first aspect, the control portion executes first control when the change of the number of operating units is detected by the detection portion, and adjusts the opening degree of the electric valve in the first control to suppress a rise of pressure of the refrigerant flowing into the operating unit. Thus, when the number of indoor units under operation is changed, the opening degree of the predetermined electric valve is adjusted and the rise of pressure of the refrigerant flowing into the operating unit is suppressed. As a result, an increase of noise in the operating unit is suppressed.

Here, the "operation stop state" includes not only a state in which operation of the indoor unit is completely stopped (e.g., a state in which operation is stopped upon input of a command to a remote controller), but also a state in which the operation is suspended (i.e., a state in which the operation is temporarily paused in accordance with thermo-off, etc.).

The "electric valve" is an electronic expansion valve of which opening degree is adjusted in the first control to suppress the rise of pressure of the refrigerant flowing into the operating unit. The installation positions and the number of electronic expansion valves are not limited to particular ones.

The "detection portion" detects the change of the number of operating units, which are the indoor units under operation, in accordance with, for example, predetermined information enabling the change of the number of operating units to be determined (e.g., a signal sent from the indoor unit or the remote controller and specifying the event that the indoor unit has come into the operation stop state, or a variable, such as a refrigerant pressure or a refrigerant temperature, on the low pressure side of a refrigeration cycle).

An air conditioning system according to a second aspect of the present invention is the air conditioning system according to the first aspect of the present invention, wherein the refrigerant flowing from the outdoor unit to the indoor units is transferred in a gas-liquid two-phase state. In the case of performing gas-liquid two-phase transfer in which the opening degree of an indoor expansion valve is set larger than that when liquid transfer is performed, a decompression in the indoor expansion valve is suppressed with the above feature from increasing temporarily when the operating capacity has changed significantly (due to significant change of operating states of multiple indoor units). As a result, an increase of noise in the operating unit in the gas-liquid two-phase transfer is suppressed.

An air conditioning system according to a third aspect of the present invention is the air conditioning system according to the first or second aspect of the present invention, wherein the control portion executes the first control when a decrease of the number of operating units is detected by the detection portion. When the multiple indoor units are brought into the operation stop state at the same time, it is estimated with a high probability that noise is generated in the indoor unit under operation. In the air conditioning system according to the third aspect, however, the generation of noise is suppressed because the control portion executes the first control when the decrease of the number of operating units is detected by the detection portion.

An air conditioning system according to a fourth aspect of the present invention is the air conditioning system according to any one of the first to third aspects of the present invention, wherein the air conditioning system further includes a storage portion. The storage portion stores capacity information. The capacity information is information specifying an air conditioning capacity of each of the indoor units. When the change of the number of operating units is detected by the detection portion, the control portion executes the first control on condition of the system being in a first state. The first state is a state in which a total value of the air conditioning capacities of the indoor units having been subject to change of an operating state is a predetermined reference value or more.

With that feature, when the change of the number of operating units is detected by the detection portion, the control portion executes the first control on condition of the system being in the first state (state in which a total value of the air conditioning capacities of the indoor units having been subject to change of an operating state is a predetermined reference value or more). In other words, whether to execute the first control or not is determined, taking into account not only the change of the number of operating units, but also the magnitude of the air conditioning capacities of the indoor units having been subject to change of the operating state. As a result, the first control can be reliably executed when the operating capacity of the entire system varies significantly (namely, when execution of the first control is more keenly required). This more reliably suppresses the increase of noise in the operating unit.

Here, the "air conditioning capacity" implies a value (kW) representing a heat-load processing capacity of the indoor unit under operation, such as a cooling capacity, and it can be converted to horsepower.

The "reference value" is a value at which the occurrence of variation in the operating capacity is estimated at such a level as possibly causing the increase of noise in the operating unit, and it is set as appropriate depending on design specifications and installation environments.

An air conditioning system according to a fifth aspect of the present invention is the air conditioning system according to any one of the first to fourth aspects of the present invention, wherein the electric valve is a first electric valve. The first electric valve decompresses the refrigerant such that the refrigerant flowing from the outdoor unit to the indoor units passes through the refrigerant connection pipe in the gas-liquid two-phase state. With this feature, an opening degree of the first electric valve is adjusted in the first control, whereby the rise of pressure of the refrigerant flowing into the operating unit is reliably and simply suppressed. As a result, the increase of noise in the operating unit incidental to the gas-liquid two-phase transfer is high-accurately suppressed while cost reduction is realized.

Here, the "first electric valve" is an electronic expansion valve "decompressing the refrigerant such that the refrigerant flowing from the outdoor unit to the indoor units passes through the refrigerant connection pipe in the gas-liquid two-phase state". Insofar as the rise of pressure of the refrigerant flowing into the operating unit is suppressed by adjusting the opening degree in the first control, the installation positions and the number of "first electric valves" are not limited to particular ones.

An air conditioning system according to a sixth aspect of the present invention is the air conditioning system according to any one of the first to fifth aspects of the present invention, wherein the electric valve is a second electric valve. The second electric valve decompresses the refrigerant that flows from the refrigerant connection pipe to the corresponding indoor unit. The control portion reduces an opening degree of the second electric valve in the first control. With this feature, the opening degree of the second electric valve is adjusted in the first control, whereby the rise of pressure of the refrigerant flowing into the operating unit is reliably and simply suppressed. As a result, the increase of noise in the operating unit incidental to the gas-liquid two-phase transfer is high-accurately suppressed while cost reduction is realized.

Here, the "second electric valve" is an electronic expansion valve "decompressing the refrigerant that flows from the refrigerant connection pipe to the corresponding indoor unit". Insofar as the rise of pressure of the refrigerant flowing into the operating unit is suppressed by adjusting the opening degree in the first control, the installation positions and the number of "second electric valves" are not limited to particular ones.

An air conditioning system according to a seventh aspect of the present invention is the air conditioning system according to any one of the first to sixth aspects of the present invention, wherein the air conditioning system further includes an outdoor heat exchanger. The outdoor heat exchanger is disposed in the outdoor unit. The outdoor heat exchanger functions as a condenser or a radiator for the refrigerant. The electric valve is a third electric valve. The third electric valve is disposed between the outdoor heat exchanger and the refrigerant connection pipe. The control portion reduces an opening degree of the third electric valve in the first control.

With that feature, the opening degree of the third electric valve is adjusted in the first control, whereby the rise of pressure of the refrigerant flowing into the operating unit is reliably and simply suppressed. As a result, the increase of noise in the operating unit incidental to the gas-liquid two-phase transfer is high-accurately suppressed while cost reduction is realized.

Here, the "third electric valve" is an electronic expansion valve "disposed between the outdoor heat exchanger and the refrigerant connection pipe". Insofar as the rise of pressure of the refrigerant flowing into the operating unit is suppressed by adjusting the opening degree in the first control, the installation positions and the number of "third electric valves" are not limited to particular ones.

DESCRIPTION OF EMBODIMENTS

An air conditioning system 100 according to one embodiment of the present disclosure will be described below. The following embodiment is a practical example and is not intended to restrict the technical scope. The embodiment can be appropriately modified without departing from the gist. The wording "operation stop state" in the following description includes not only a state in which operation is stopped in accordance with input of a command instructing stop of the operation or with cutoff of power supply, but also a state in which the operation is suspended in accordance with thermo-off, etc.

(1) Outline of Air Conditioning System 100

Figure 1:
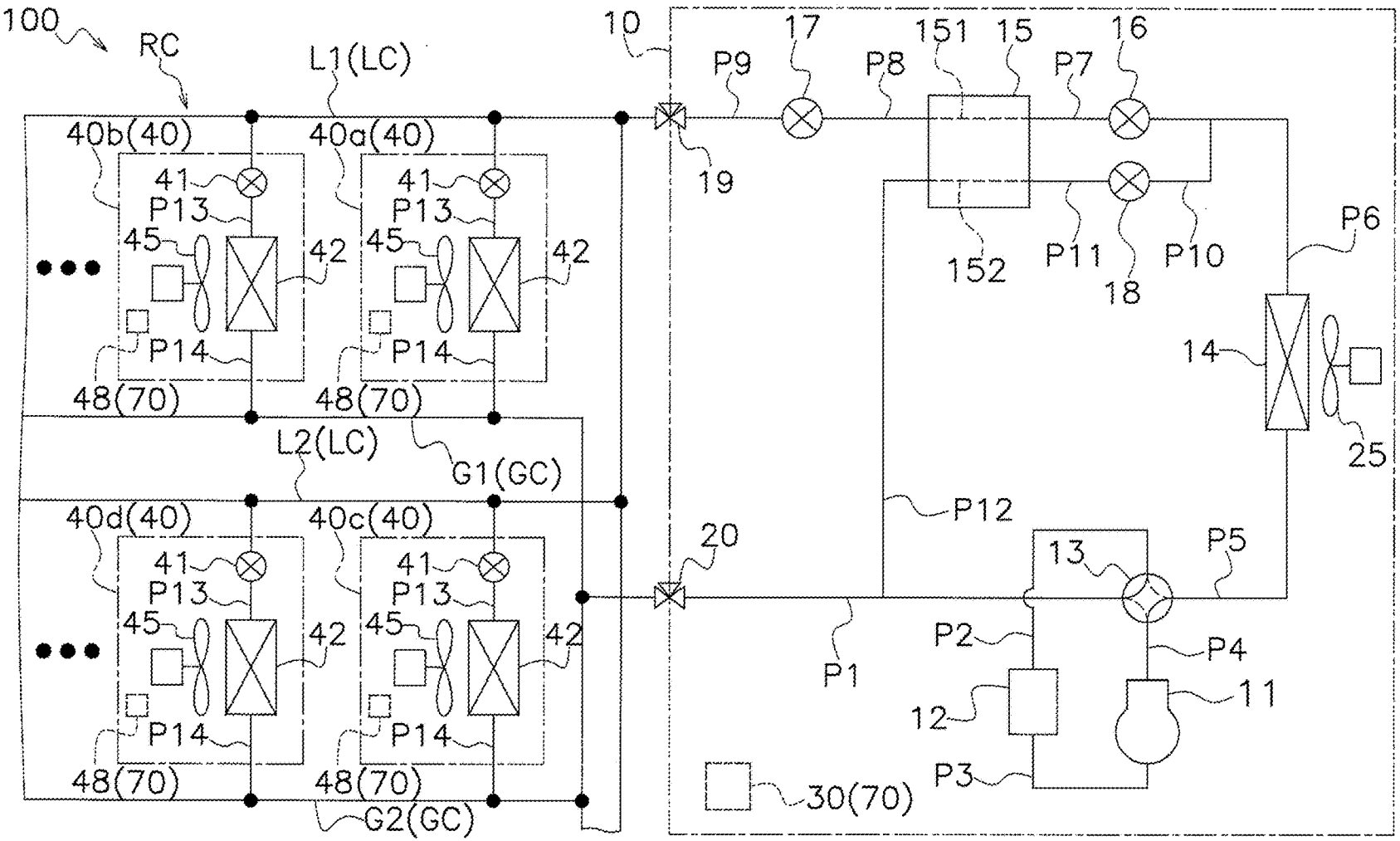
FIG. 1 is a schematic view illustrating a configuration of an air conditioning system according to one embodiment of the present disclosure.

FIG. 1 is a schematic view illustrating a configuration of the air conditioning system 100. The air conditioning system 100 is installed in a building, a factory, etc. and implements air conditioning in a target space. The air conditioning system 100 performs cooling, heating, etc. in the target space through a refrigeration cycle carried out in a refrigerant circuit RC.

The air conditioning system 100 mainly includes an outdoor unit 10, a plurality (four or more here) of indoor units 40 (40*a*, 40*b*, 40*c*, 40*d*, etc.), a liquid-side connection pipe LC and a gas-side connection pipe GC both connecting the outdoor unit 10 and the indoor units 40, and a controller 70 controlling operation of the air conditioning system 100.

In the air conditioning system 100, the outdoor unit 10 and the indoor units 40 are connected by the liquid-side connection pipe LC and the gas-side connection pipe GC, whereby the refrigerant circuit RC is constituted. The air conditioning system 100 carries out a vapor compression refrigeration cycle in which a refrigerant enclosed in the refrigerant circuit RC is compressed, cooled or condensed, decompressed, heated or evaporated, and compressed again. For example, a refrigerant R32 is enclosed in the refrigerant circuit RC.

In the air conditioning system 100, liquid-gas two-phase transfer of transferring the refrigerant in a liquid-gas two-phase state is performed in the liquid-side connection pipe LC extending between the outdoor unit 10 and the indoor units 40. More specifically, for the purpose of realizing refrigerant conservation, the air conditioning system 100 is constituted to perform the liquid-gas two-phase transfer in the liquid-side connection pipe LC, taking into account of the fact that, regarding the refrigerant transferred through the liquid-side connection pipe LC extending between the outdoor unit 10 and the indoor units 40, the operation can be performed with a smaller amount of the refrigerant to be filled and less reduction of performance when the refrigerant is transferred in the liquid-gas two-phase state than when transferred in a liquid state.

The heat load defined here is a heat load demanded to be processed by the indoor units 40 under operation (i.e., the operating units), and is calculated on the basis of, for example, some/all of the setting temperatures set in the operating units, the temperature in the target space where the operating units are installed, the amount of circulating refrigerant, the number of rotations of an indoor fan 45, the number of rotations of a compressor 11, the capacity of an outdoor heat exchanger 14, the capacity of an indoor heat exchanger 42, etc.

(1-1) Outdoor Unit 10

The outdoor unit 10 is installed, for example, outdoors on the rooftop or the veranda of a building, or outside a room (target space), such as in the basement. The outdoor unit 10 is connected to the indoor units 40 through the liquid-side connection pipe LC and the gas-side connection pipe GC, and it constitutes part of the refrigerant circuit RC.

The outdoor unit 10 mainly includes a plurality of refrigerant pipes (i.e., a first pipe P1 to a twelfth pipe P12), the compressor 11, an accumulator 12, a four-way switching valve 13, the outdoor heat exchanger 14, a subcooler 15, a first outdoor control valve 16, a second outdoor control valve 17, a third outdoor control valve 18, a liquid-side shutoff valve 19, and a gas-side shutoff valve 20.

The first pipe P1 connects the gas-side shutoff valve 20 and a first port of the four-way switching valve 13. The second pipe P2 connects an inlet port of the accumulator 12 and a second port of the four-way switching valve 13. The third pipe P3 connects an outlet port of the accumulator 12 and a suction port of the compressor 11. The fourth pipe P4 connects a discharge port of the compressor 11 and a third port of the four-way switching valve 13. The fifth pipe P5 connects a fourth port of the four-way switching valve 13 and a gas-side outlet/inlet of the outdoor heat exchanger 14. The sixth pipe P6 connects a liquid-side outlet/inlet of the outdoor heat exchanger 14 and one end of the first outdoor control valve 16. The seventh pipe P7 connects the other end of the first outdoor control valve 16 and one end of a main flow path 151 of the subcooler 15. The eighth pipe P8 connects the other end of the main flow path 151 of the subcooler 15 and one end of the second outdoor control valve 17. The ninth pipe P9 connects the other end of the second outdoor control valve 17 and one end of the liquid-side shutoff valve 19. The tenth pipe P10 connects a portion between both ends of the sixth pipe P6 and one end of the third outdoor control valve 18. The eleventh pipe P11 connects the other end of the third outdoor control valve 18 and one end of a sub-flow path 152 of the subcooler 15. The twelfth pipe P12 connects the other end of the sub-flow path 152 of the subcooler 15 and a portion between both ends of the first pipe P1. In practice, the refrigerant pipes (P1 to P12) may be each constituted by a single pipe or by a plurality of pipes connected through joints, etc.

The compressor 11 is a device compressing the refrigerant at a low pressure in the refrigeration cycle up to a high pressure. In this embodiment, the compressor 11 has a hermetic structure in which a displacement compression element of rotary type or scroll type is driven and rotated by a compressor motor (not illustrated). Furthermore, the operating frequency of the compressor motor can be controlled by an inverter, whereby the capacity of the compressor 11 can be controlled.

The accumulator 12 is a container for suppressing excessive suction of the liquid refrigerant into the compressor 11. The accumulator 12 has a predetermined capacity depending on the amount of refrigerant filled in the refrigerant circuit RC.

The four-way switching valve 13 is a flow path switching valve for switching a flow of the refrigerant in the refrigerant circuit RC. The four-way switching valve 13 can switch a forward cycle state and a reverse cycle state. In the forward cycle state, the four-way switching valve 13 communicates the first port (first pipe P1) and the second port (second pipe P2) with each other and the third port (fourth pipe P4) and the fourth port (fifth pipe P5) with each other (see solid lines in the four-way switching valve 13 in FIG. 1). In the reverse cycle state, the four-way switching valve 13 communicates the first port (first pipe P1) and the third port (fourth pipe P4) with each other and the second port (second pipe P2) and the fourth port (fifth pipe P5) with each other (see dashed lines in the four-way switching valve 13 in FIG. 1).

The outdoor heat exchanger 14 is a heat exchanger functioning as a condenser (radiator) or an evaporator (heater) for the refrigerant. In a forward cycle operation (i.e., an operation in which the four-way switching valve 13 is in the forward cycle state), the outdoor heat exchanger 14 functions as the condenser for the refrigerant. In a reverse cycle operation (i.e., an operation in which the four-way switching valve 13 is in the reverse cycle state), the outdoor heat exchanger 14 functions as the evaporator for the refrigerant. The outdoor heat exchanger 14 includes a plurality of heat transfer tubes and a plurality of heat transfer fins (though not illustrated). The outdoor heat exchanger 14 performs heat exchange between the refrigerant in the heat transfer tubes and air (outdoor air flow described later) passing around the heat transfer tubes or the heat transfer fins.

The subcooler 15 is a heat exchanger converting the incoming refrigerant to the liquid refrigerant in a subcooled state. The subcooled 15 is, for example, a double-tube heat exchanger and includes the main flow path 151 and the sub-flow path 152. The subcooler 15 performs heat exchange between the refrigerants flowing through the main flow path 151 and the sub-flow path 152.

The first outdoor control valve 16 is an electronic expansion valve capable of controlling an opening degree, and it decompresses the incoming refrigerant or adjusts a flow rate thereof depending on the opening degree. The first outdoor control valve 16 is disposed between the outdoor heat exchanger 14 and the subcooler 15 (main flow path 151). In other words, the first outdoor control valve 16 is disposed in association with the outdoor heat exchanger 14 and the liquid-side connection pipe LC.

The second outdoor control valve 17 (corresponding to a "first electric valve" in claims) is an electronic expansion valve capable of controlling an opening degree, and it decompresses the incoming refrigerant or adjusts a flow rate thereof depending on the opening degree. The second outdoor control valve 17 is disposed between the subcooler 15 (main flow path 151) and the liquid-side shutoff valve 19. The refrigerant delivered from the outdoor unit 10 to the liquid-side connection pipe LC can be decompressed into the gas-liquid two-phase state by controlling the opening degree of the second outdoor control valve 17.

The third outdoor control valve 18 is an electronic expansion valve capable of controlling an opening degree, and it decompresses the incoming refrigerant or adjusts a flow rate thereof depending on the opening degree. The third outdoor control valve 18 is disposed between the outdoor heat exchanger 14 and the subcooler 15 (sub-flow path 152).

The liquid-side shutoff valve 19 is a manual valve disposed in a joint portion between the ninth pipe P9 and the liquid-side connection pipe LC. One end of the liquid-side shutoff valve 19 is connected to the ninth pipe P9, and the other end is connected to the liquid-side connection pipe LC.

The gas-side shutoff valve 20 is a manual valve disposed in a joint portion between the first pipe P1 and the gas-side connection pipe GC. One end of the gas-side shutoff valve 20 is connected to the first pipe P1, and the other end is connected to the gas-side connection pipe GC.

The outdoor unit 10 further includes an outdoor fan 25 producing the outdoor air flow that flows through the outdoor heat exchanger 14. The outdoor fan 25 is a blower supplying, to the outdoor heat exchanger 14, the outdoor air flow that serves as a cooling or heating source for the refrigerant flowing through the outdoor heat exchanger 14. The outdoor fan 25 includes an outdoor fan motor (not illustrated) serving as a drive source, and the start/stop of operation and the number of rotations of the outdoor fan 25 are controlled depending on situations.

A plurality of outdoor sensors 26 (see FIG. 3) each detecting a state (mainly pressure or temperature) of the refrigerant in the refrigerant circuit RC are disposed in the outdoor unit 10. The outdoor sensors 26 are a pressure sensor and a temperature sensor such as a thermistor or a thermocouple. The outdoor sensors 26 include, for example, a suction pressure sensor detecting a suction pressure LP that is the pressure of the refrigerant on the suction side of the compressor 11, a discharge pressure sensor detecting a discharge pressure HP that is the pressure of the refrigerant on the discharge side of the compressor 11, a refrigerant temperature sensor detecting a temperature (e.g., a degree of subcooling SC) of the refrigerant in the outdoor heat exchanger 14, and an open-air temperature sensor detecting a temperature of open air.

In addition, the outdoor unit 10 includes an outdoor unit controller 30 controlling operations and states of various devices in the outdoor unit 10. The outdoor unit controller 30 includes a microcomputer including a CPU, a memory, etc. The outdoor unit controller 30 is electrically connected to the various devices (11, 13, 16, 17, 18, 25, etc.) and the outdoor sensors 26 in the outdoor unit 10 for input and output of signals from and to them. Moreover, the outdoor unit controller 30 individually transmits and receives control signals, etc. to and from indoor unit controllers 48 (described later) of the indoor units 40 and a remote controller 60 (see FIG. 3) via communication lines (not illustrated).

(1-2) Indoor Unit 40

Each of the indoor units 40 is connected to the outdoor unit 10 through the liquid-side connection pipe LC and the gas-side connection pipe GC. With respect to the outdoor unit 10, each indoor unit 40 is arranged in parallel or in series to the other one or more indoor units 40. In FIG. 1, for example, the indoor unit 40*a* is arranged in series to the indoor unit 40*b*, etc. and in parallel to the indoor units 40*c*, 40*d*, etc.

Each indoor unit 40 is disposed in the target space and constitutes part of the refrigerant circuit RC. Each indoor unit 40 mainly includes a plurality of refrigerant pipes (i.e., a thirteenth pipe P13 and a fourteenth pipe P14), an indoor expansion valve 41, and the indoor heat exchanger 42.

The thirteenth pipe P13 connects the liquid-side connection pipe LC and a liquid-side refrigerant outlet/inlet of the indoor heat exchanger 42. The fourteenth pipe P14 connects a gas-side refrigerant outlet/inlet of the indoor heat exchanger 42 and the gas-side connection pipes GC. In practice, the refrigerant pipes (P13 and P14) may be each constituted by a single pipe or by a plurality of pipes connected through joints, etc.

The indoor expansion valve 41 is an electronic expansion valve capable of controlling an opening degree, and it decompresses the incoming refrigerant or adjusts a flow rate thereof depending on the opening degree. The indoor expansion valve 41 is disposed in the thirteenth pipe P13 and is positioned between the liquid-side connection pipe LC and the indoor heat exchanger 42. During the forward cycle operation, the indoor expansion valve 41 decompresses the refrigerant flowing into the indoor unit 40 from the liquid-side connection pipe LC.

The indoor heat exchanger 42 is a heat exchanger functioning as an evaporator (heater) or a condenser (radiator) for the refrigerant. In the forward cycle operation, the indoor heat exchanger 42 functions as the evaporator for the refrigerant. In the reverse cycle operation, the indoor heat exchanger 42 functions as the condenser for the refrigerant. The indoor heat exchanger 42 includes a plurality of heat transfer tubes and a plurality of heat transfer fins (though not illustrated). The indoor heat exchanger 42 performs heat exchange between the refrigerant in the heat transfer tubes and air (indoor air flow described later) passing around the heat transfer tubes or the heat transfer fins.

The indoor unit 40 further includes the indoor fan 45 for sucking air in the target space, causing the sucked air to pass through the indoor heat exchanger 42 for heat exchange with the refrigerant, and then delivering the air to the target space again. The indoor fan 45 is disposed in the target space. The indoor fan 45 includes an indoor fan motor (not illustrated) serving as a drive source. The indoor fan 45 produces, when driven, the indoor air flow that serves as a cooling or heating source for the refrigerant flowing through the indoor heat exchanger 42.

Indoor sensors 46 (see FIG. 3) each detecting a state (mainly pressure or temperature) of the refrigerant in the refrigerant circuit RC are disposed in the indoor unit 40. The indoor sensors 46 are a pressure sensor and a temperature sensor such as a thermistor or a thermocouple. The indoor sensors 46 include, for example, a temperature sensor detecting a temperature (e.g., a degree of subcooling) of the refrigerant in the indoor heat exchanger 42 and a pressure sensor detecting a pressure of the refrigerant.

In addition, the indoor unit 40 includes an indoor unit controller 48 controlling operations and states of various devices in the indoor unit 40. The indoor unit controller 48 includes a microcomputer including a CPU, a memory, etc. The indoor unit controller 48 is electrically connected to the various devices (41 and 45) and the indoor sensors 46 in the indoor unit 40 for input and output of signals from and to them. Moreover, the indoor unit controller 48 is connected to the outdoor unit controller 30 and the remote controller 60 (see FIG. 3) via communication lines (not illustrated) for transmission and reception of control signals, etc.

(1-3) Liquid-Side Connection Pipe LC and Gas-Side Connection Pipe GC

The liquid-side connection pipe LC and the gas-side connection pipe GC are connection pipes connecting the outdoor unit 10 and the indoor units 40, and those pipes are installed in the field. Lengths and diameters of the liquid-side connection pipe LC and the gas-side connection pipe GC are selected as appropriate depending on the design specifications and the installation environments. In practice, the liquid-side connection pipe LC and the gas-side connection pipe GC may be each constituted by a single pipe or by a plurality of pipes connected through joints, etc.

In this embodiment, the liquid-side connection pipe LC is branched into a plurality of pipes (liquid-side connection pipes L1, L2, etc.). The gas-side connection pipe GC is also branched into a plurality of pipes (gas-side connection pipes G1, G2, etc.). In FIG. 1, the indoor units 40*a*, 40*b*, etc. are individually connected to the liquid-side connection pipe L1 and the gas-side connection pipe G1, and the indoor units 40*c*, 40*d*, etc. are individually connected to the liquid-side connection pipe L2 and the gas-side connection pipe G2.

(1-4) Controller 70

The controller 70 (corresponding to a "detection portion" and a "control portion" in claims) is a computer that controls operation of the air conditioning system 100 by controlling states of the various devices. In this embodiment, the controller 70 is constituted by the outdoor unit controller 30 and the indoor unit controllers 48 in the indoor units 40, which are connected via communication lines. Details of the controller 70 will be described below in "(3) Details of Controller 70".

(2) Refrigerant Flow in Refrigerant Circuit RC

A refrigerant flow in the refrigerant circuit RC is described here. The forward cycle operation such as a cooling operation and the reverse cycle operation such as a heating operation are mainly performed in the air conditioning system 100. In this embodiment, the low pressure in the refrigeration cycle is a pressure of the refrigerant sucked into the compressor 11, and the high pressure in the refrigeration cycle is a pressure of the refrigerant discharged from the compressor 11. The indoor expansion valve 41 of the indoor unit 40 in the operation stop state (operation suspended state) is controlled into a closed state.

(2-1) Refrigerant Flow During Forward Cycle Operation

Figure 2:
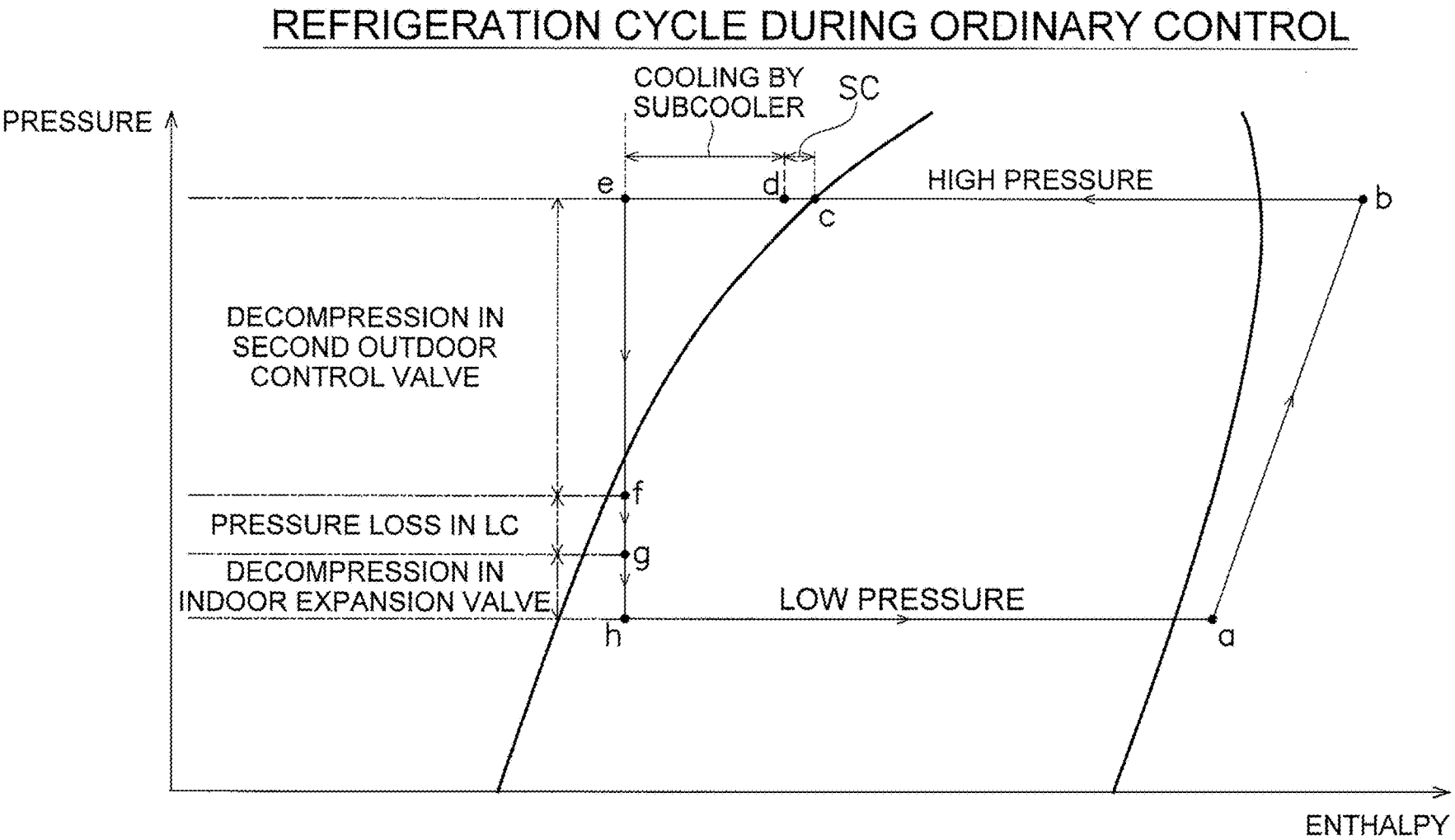
FIG. 2 is a chart illustrating an example of a refrigeration cycle during forward cycle operation (during ordinary control).

FIG. 2 is a chart illustrating an example of the refrigeration cycle during the forward cycle operation (during ordinary control). During the forward cycle operation, the four-way switching valve 13 is controlled into the forward cycle state, and the refrigerant filled in the refrigerant circuit RC circulates through mainly the compressor 11, the outdoor heat exchanger 14, the first outdoor control valve 16, the subcooler 15 (main flow path 151), the second outdoor control valve 17, the indoor expansion valve 41 and the indoor heat exchanger 42 of the indoor unit 40 under operation (i.e., the operating unit), and the compressor 11 in the mentioned order. In the forward cycle operation, part of the refrigerant flowing through the sixth pipe P6 diverges into the ninth pipe P9 and returns to the compressor 11 after passing through the third outdoor control valve 18 and the subcooler 15 (sub-flow path 152).

More specifically, when the forward cycle operation is started, the refrigerant is sucked into the compressor 11 and discharged in the outdoor unit 10 after being compressed up to the high pressure in the refrigeration cycle (see a-b in FIG. 2). The compressor 11 undergoes capacity control depending on the heat load demanded by the operating unit. In practice, a target value of the suction pressure LP (see a in FIG. 2) is set depending on the heat load demanded by the indoor unit 40, and the operating frequency of the compressor 11 is controlled such that the suction pressure LP is kept at the target value. The gas refrigerant discharged from the compressor 11 flows into the gas-side outlet/inlet of the outdoor heat exchanger 14.

The gas refrigerant having flowed into the outdoor heat exchanger 14 radiates heat through heat exchange with the outdoor air flow delivered from the outdoor fan 25 and is condensed in the outdoor heat exchanger 14 (see b-d in FIG. 2). At that time, the refrigerant becomes the liquid refrigerant in the subcooled state with the degree of subcooling SC (see c-d in FIG. 2). The refrigerant having flowed out from the liquid-side outlet/inlet of the outdoor heat exchanger 14 diverges in the middle of flowing through the sixth pipe P6.

One part of the refrigerant having diverged in the middle of flowing through the sixth pipe P6 flows into the main flow path 151 of the subcooler 15 through the first outdoor control valve 16. The refrigerant having flowed into the main flow path 151 of the subcooler 15 is cooled by performing heat exchange with the refrigerant flowing through the sub-flow path 152 and comes into a state with a further subcooled state (see d-e in FIG. 2).

The liquid refrigerant having flowed out from the main flow path 151 of the subcooler 15 is decompressed or adjusted in flow rate depending on the opening degree of the second outdoor control valve 17, thus coming into the gas-liquid two-phase state and turning to the refrigerant under an intermediate pressure that is lower than the pressure of the high-pressure refrigerant and higher than the pressure of the low-pressure refrigerant (see e-f in FIG. 2). During the forward cycle operation, therefore, the refrigerant in the gas-liquid two-phase state is delivered to the liquid-side connection pipe LC, and gas-liquid two-phase transfer is realized with respect to the refrigerant delivered from the outdoor unit 10 toward the indoor unit 40. As a result, the liquid-side connection pipe LC is less likely filled with the liquid refrigerant than in the case of liquid transfer in which the refrigerant flowing through the liquid-side connection pipe LC is in the liquid state, and the amount of refrigerant present in the liquid-side connection pipe LC can be reduced correspondingly.

In this embodiment, the opening degree of the second outdoor control valve 17 is controlled as appropriate such that the degree of subcooling SC (see c-d in FIG. 2) of the refrigerant on the liquid side of the outdoor heat exchanger 14 is kept at a target degree of subcooling. More specifically, the opening degree of the second outdoor control valve 17 is increased when the degree of subcooling SC is larger than the target degree of subcooling, and it is reduced when the degree of subcooling SC is smaller than the target degree of subcooling.

The pressure of the gas-liquid two-phase refrigerant having flowed out from the outdoor unit 10 lowers due to a pressure loss while flowing through the liquid-side connection pipe LC (see f-g in FIG. 2). Then, the refrigerant flows into the operating unit.

The other part of the refrigerant having diverged in the middle of flowing through the sixth pipe P6 flows into the third outdoor control valve 18 and further flows into the sub-flow path 152 of the subcooler 15 after being decompressed or adjusted in flow rate depending on the opening degree of the third outdoor control valve 18. The refrigerant having flowed into the sub-flow path 152 of the subcooler 15 undergoes heat exchange with the refrigerant flowing through the main flow path 151 and merges with the refrigerant flowing through the first pipe P1 after passing through the twelfth pipe P12.

The refrigerant having flowed into the operating unit flows into the indoor expansion valve 41 and is decompressed to the low pressure in the refrigeration cycle depending on the opening degree of the indoor expansion valve 41 (see g-h in FIG. 2), and then flows into the indoor heat exchanger 42.

As described above, the gas-liquid two-phase transfer is performed in the refrigerant circuit RC. Therefore, a decompression (see g-h in FIG. 2) in the indoor expansion valve 41 is smaller than a decompression (corresponding to the pressure resulting from subtracting the pressure loss in the liquid-side connection pipe LC from the pressure difference between e-h in FIG. 2) when the liquid transfer is performed. In this respect, the opening degree of the indoor expansion valve 41 is increased in comparison with that when the liquid transfer is performed.

The refrigerant having flowed into the indoor heat exchanger 42 is evaporated by performing heat exchange with the indoor air flow delivered from the indoor fan 45 and becomes the gas refrigerant (see h-a in FIG. 2). The gas refrigerant having flowed out from the indoor heat exchanger 42 then flows out from the indoor unit 40.

After having flowed out from the indoor unit 40, the gas refrigerant flows through the gas-side connection pipe GC and then flows into the outdoor unit 10. The refrigerant having flowed into the outdoor unit 10 flows through the first pipe P1 and then flows into the accumulator 12 through the four-way switching valve 13 and the second pipe P2. The refrigerant having flowed into the accumulator 12 is temporarily accumulated and then sucked into the compressor 11 again.

(2-2) Refrigerant Flow in Reverse Cycle Operation

During the reverse cycle operation, the four-way switching valve 13 is controlled into the reverse cycle state, and the refrigerant filled in the refrigerant circuit RC circulates through mainly the compressor 11, the indoor heat exchanger 42 and the indoor expansion valve 41 of the operating unit, the second outdoor control valve 17, the subcooler 15, the first outdoor control valve 16, the outdoor heat exchanger 14, and the compressor 11 in the mentioned order.

More specifically, when the reverse cycle operation is started, the refrigerant is sucked into the compressor 11 and discharged after being compressed up to the high pressure. The compressor 11 undergoes capacity control depending on the heat load demanded by the operating unit. The gas refrigerant discharged from the compressor 11 flows out from the outdoor unit 10 through the fourth pipe P4 and the first pipe P1, and then flows into the operating unit through the gas-side connection pipe GC.

The refrigerant having flowed into the indoor unit 40 flows into the indoor heat exchanger 42 and is condensed by performing heat exchange with the indoor air flow delivered from the indoor fan 45. The refrigerant having flowed out from the indoor heat exchanger 42 flows into the indoor expansion valve 41 and is decompressed to the low pressure in the refrigeration cycle depending on the opening degree of the indoor expansion valve 41. Then, the refrigerant flows out from the indoor unit 40.

The refrigerant having flowed out from the indoor unit 40 flows into the operating unit through the liquid-side connection pipe LC. The refrigerant having flowed into the outdoor unit 10 passes through the ninth pipe P9, the second outdoor control valve 17, the eighth pipe P8, the subcooler 15 (main flow path 151), the seventh pipe P7, the first outdoor control valve 16, and the sixth pipe P6, and then flows into the liquid-side outlet/inlet of the outdoor heat exchanger 14.

The refrigerant having flowed into the outdoor heat exchanger 14 is evaporated in the outdoor heat exchanger 14 by performing heat exchange with the outdoor air flow delivered from the outdoor fan 25. Then, the refrigerant flows out from the gas-side outlet/inlet of the outdoor heat exchanger 14 and flows into the accumulator 12 through the fifth pipe P5, the four-way switching valve 13, and the second pipe P2. The refrigerant having flowed into the accumulator 12 is temporarily accumulated and then sucked into the compressor 11 again.

(3) Details of Controller 70

Figure 3:
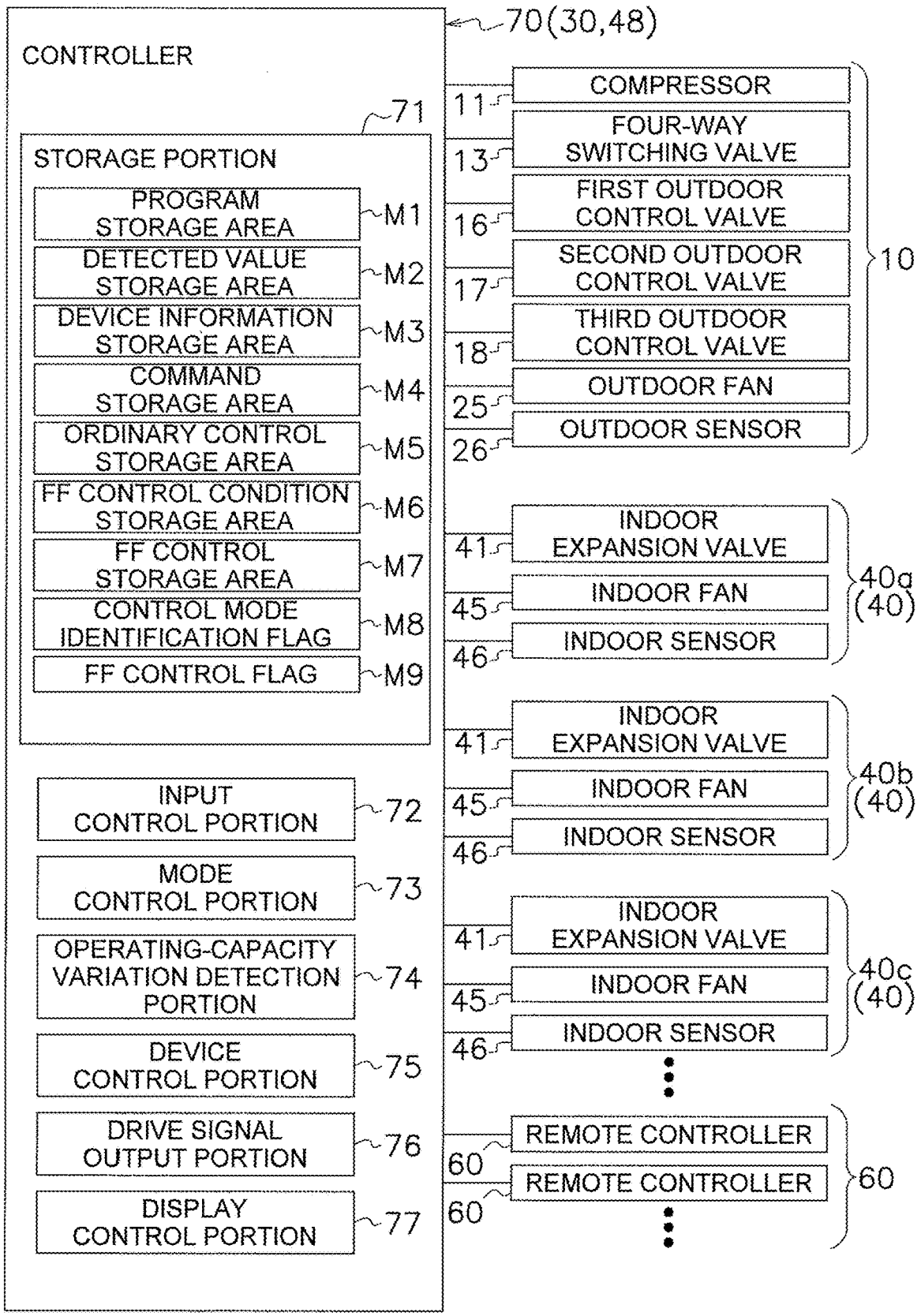
FIG. 3 is a block diagram schematically illustrating a controller and various components connected to the controller.

In the air conditioning system 100, the controller 70 is constituted by the outdoor unit controller 30 and the indoor unit controllers 48 both connected via communication lines. FIG. 3 is a block diagram schematically illustrating the controller 70 and various devices connected to the controller 70.

The controller 70 has a plurality of control modes and controls operations of the individual devices depending on the selected control mode. In this embodiment, the controller 70 has, as the control modes, a forward cycle operation mode selected during the forward cycle operation such as the cooling operation, and a reverse cycle operation mode selected during the reverse cycle operation such as the heating operation.

The controller 70 is electrically connected to the devices in the air conditioning system 100 (specifically, such as the compressor 11, the first outdoor control valve 16, the second outdoor control valve 17, the third outdoor control valve 18, the outdoor fan 25, and the outdoor sensors 26 that are incorporated in the outdoor unit 10, the indoor expansion valve 41, the indoor fan 45, and the indoor sensors 46 that are incorporated in each of the indoor units 40, and the remote controllers 60).

The controller 70 mainly includes a storage portion 71, an input control portion 72, a mode control portion 73, an operating-capacity variation detection portion 74, a device control portion 75, a drive signal output portion 76, and a display control portion 77. Those functional portions in the controller 70 are implemented by the CPUs, the memories, and the various electric and electronic components incorporated the outdoor unit controller 30 and/or the indoor unit controller(s) 48, which function in a cooperating manner.

(3-1) Storage Portion 71

The storage portion 71 is constituted by, for example, a ROM, a RAM, or a flash memory, and includes a volatile storage area and a nonvolatile storage area. The storage portion 71 includes a program storage area M1 that stores control programs defining various types of processing executed in the individual portions of the controller 70.

The storage portion 71 further includes a detected value storage area M2 that stores detected values of the various sensors. For example, detected values of the outdoor sensors 26 and the indoor sensors 46 (such as the suction pressure LP, the discharge pressure HP, the refrigerant temperature in the outdoor heat exchanger 14, and the refrigerant temperature in the indoor heat exchanger 42) are stored in the detected value storage area M2.

The storage portion 71 still further includes a device information storage area M3 that stores information (device information) specifying characteristics and states of the individual devices in the air conditioning system 100. The device information stored in the device information storage area M3 is, for example, the number of rotations (frequency) of the compressor 11, the number of rotations (airflow volume) of the outdoor fan 25, the number of rotations (airflow volume) of each indoor fan 45, the opening degree (pulse) of each of the control valves (i.e., the first outdoor control valve 16, the second outdoor control valve 17, the third outdoor control valve 18, and the indoor expansion valves 41), and the state of the four-way switching valve 13. The device information stored in the device information storage area M3 is updated from time to time when the operating state of each device is changed. Moreover, the device information contains Cv values of the individual electric valves (16, 17, 18 and 41) (the Cv value being a coefficient representing flow rate characteristics and having correlation with the opening degree). In addition, the device information contains capacity information specifying the air conditioning capacity of each indoor unit 40. The term "air conditioning capacity" is a value (kW) representing a heat-load processing capacity of the indoor unit during the operation, such as a cooling capacity, and it can be converted to horsepower. The air conditioning capacity of the indoor unit 40 is determined on the basis of mainly the capacity of the indoor heat exchanger 42.

The storage portion 71 still further includes a command storage area M4 that stores commands having been input to the individual remote controllers 60.

The storage portion 71 still further includes an ordinary control storage area M5 that stores a table (ordinary control table) defining control details in ordinary control (described later). The ordinary control table is updated from time to time by a supervisor.

The storage portion 71 still further includes an FF control condition storage area M6 that stores a table (FF control condition table) defining an FF control condition for triggering execution of feed-forward control (described later). The FF control condition table (predetermined information) is set depending on the design specifications and the installation environments, and defines, for each situation, the FF control condition corresponding to, for example, the state of each device, the detected value of each sensor 26 or 46, or an input command. The FF control condition table is updated from time to time by the supervisor.

The storage portion 71 still further includes an FF control storage area M7 that stores a table (FF control table) defining control details in the feed-forward control. The FF control table is updated from time to time by the supervisor.

A plurality of flags each having a predetermined number of bits are included in the storage portion 71. Thus, the storage portion 71 includes, for example, a control mode identification flag M8 capable of identifying a control mode to which the controller 70 is transited. The control mode identification flag M8 contains a plurality of bits corresponding to the number of control modes and can set the bit corresponding to the control mode to which the controller is transited.

The storage portion 71 further includes an FF control flag M9 for identifying whether the FF control condition is satisfied. The FF control flag M9 is set when the operating-capacity variation detection portion 74 determines that the FF control condition is satisfied. The FF control flag M9 is cleared by the device control portion 75 when the feed-forward control is completed. The FF control flag M9 has a predetermined number of bits and can set a different bit corresponding to the degree of variation in the operating capacity. In other words, the FF control flag M9 is constituted to be able to determine not only the fact that the FF control condition is satisfied (namely, that the operating capacity is varied significantly), but also the degree of variation in the operating capacity.

(3-2) Input Control Portion 72

The input control portion 72 is a functional portion serving as an interface for receiving signals output from the individual devices connected to the controller 70. For example, the input control portion 72 receives signals output from the sensors (26 and 46) and the remote controllers 60, and stores the signals in the corresponding storage areas of the storage portion 71 or sets the predetermined flag.

(3-3) Mode Control Portion 73

The mode control portion 73 is a functional portion switching the control mode. When a command instructing execution of the forward cycle operation is input, the mode control portion 73 switches the control mode to the forward cycle operation mode. When a command instructing execution of the reverse cycle operation is input, the mode control portion 73 switches the control mode to the reverse cycle operation mode. The mode control portion 73 sets the control mode identification flag M8 corresponding to the selected control mode.

(3-4) Operating-Capacity Variation Detection Portion 74

The operating-capacity variation detection portion 74 (corresponding to the "detection portion" in claims) is a functional portion detecting a significant variation in the operating capacity of the air conditioning system 100. More specifically, when the FF control condition is satisfied on the basis of the FF control condition table, the operating-capacity variation detection portion 74 determines that the significant variation has occurred in the operating capacity of the air conditioning system 100, and then sets the FF control flag M9. The FF control condition is previously defined, as a condition on which the occurrence of the significant variation in the operating capacity is estimated, in the FF control condition table depending on the design specifications and the installation environments.

In this embodiment, the FF control condition is satisfied when the number of indoor units 40 under operation (i.e., operating units) is changed during the forward cycle operation in excess of a predetermined rate. For example, the FF control condition is satisfied when the number of operating units decreases by a predetermined number (e.g., two) or more for a predetermined period Pt (e.g., 30 sec) (namely, it is satisfied when a predetermined number or more of operating units come into the operation stop state). In another example, the FF control condition is satisfied when the number of operating units increases by a predetermined number (e.g., two) or more for a predetermined period Pt (e.g., 30 sec) (namely, it is satisfied when a predetermined number or more of indoor units 40 in the operation stop state come into the operating state). The predetermined period Pt is defined for each situation depending on the design specifications, the installation environments, usage conditions (such as the number of operating units, the number of stopped units, the degree of variation in the operating capacity, the magnitude of the heat load, and the device information), etc. of the system.

While referring to the FF control condition table stored in the FF control condition storage area M6, the operating-capacity variation detection portion 74 determines whether the FF control condition is satisfied, on the basis of various items of information stored in the storage portion 71 (such as the detected values of the sensors 26 and/or 46 and stored in the detected value storage area M2, the device information stored in the device information storage area M3, and/or the input command stored in the command storage area M4). In addition, the operating-capacity variation detection portion 74 is able to measure time.

Furthermore, when the FF control condition is satisfied, the operating-capacity variation detection portion 74 specifies the degree of variation in the operating capacity and sets the FF control flag M9 at one of the different bits depending on the degree of the variation.

(3-5) Device Control Portion 75

The device control portion 75 (corresponding to the "control portion" in claims) controls operations of the individual devices (e.g., 11, 13, 16, 17, 18, 25, 41 and 45) in the air conditioning system 100 according to the control programs depending on situations. The device control portion 75 identifies the selected control mode by referring to the control mode identification flag M8 and controls the operations of the individual devices in accordance with the control mode and the detected values of the sensors 26 and/or 46.

The device control portion 75 executes various types of control depending on situations. In an example, for the operating unit to which the command instructing the stop of the operation is input, and for the operating unit in which the indoor temperature has reached the setting temperature, the device control portion 75 stops the indoor fan 45 and controls the indoor expansion valve 41 into the closed state, thereby bringing the relevant operating unit into the operation stop state.

In another example, the device control portion 75 executes the ordinary control and the feed-forward control, described below, depending on situations. The device control portion 75 is able to measure time.

(Ordinary Control)

During the operation in the ordinary state (in which the FF control condition is not satisfied, namely in which the FF control flag M9 is not set), the device control portion 75 executes the ordinary control in accordance with the ordinary control table, which is stored in the ordinary control storage area M5, depending on the input command, the heat load, etc.

In the forward cycle operation mode, the device control portion 75 controls in real time the number of rotations of the compressor 11, the number of rotations of each of the outdoor fan 25 and the indoor fan 45, the opening degree of the second outdoor control valve 17, the opening degree of the third outdoor control valve 18, the opening degrees of the indoor expansion valve 41, etc. depending on the setting temperature, the detected values of the sensors, etc. in order to perform the forward cycle operation such that the suction pressure LP, the discharge pressure HP, the degree of subcooling SC, the degree of superheating, etc. are kept at target values. During the forward cycle operation, the device control portion 75 controls the four-way switching valve 13 into the forward cycle state, thus causing the outdoor heat exchanger 14 to function as the condenser (or the radiator) for the refrigerant and the indoor heat exchanger 42 of the operating unit to function as the evaporator (or the heater) for the refrigerant.

In the reverse cycle operation mode, the device control portion 75 controls in real time the number of rotations of the compressor 11, the number of rotations of each of the outdoor fan 25 and the indoor fan 45, the opening degree of the first outdoor control valve 16, the opening degree of the indoor expansion valve 41, etc. depending on the setting temperature, the detected values of the sensors, etc. in order to perform the reverse cycle operation. During the reverse cycle operation, the device control portion 75 controls the four-way switching valve 13 into the reverse cycle state, thus causing the outdoor heat exchanger 14 to function as the evaporator (or the heater) for the refrigerant and the indoor heat exchanger 42 of the operating unit to function as the condenser (or the radiator) for the refrigerant.

(Feed-Forward Control)

During the forward cycle operation, when the FF control condition is satisfied (namely, when the FF control flag M9 is set), the device control portion 75 executes the feed-forward control (corresponding to "first control" in claims) in accordance with the FF control table stored in the FF control storage area M7. The feed-forward control is to, upon the occurrence of the significant variation in the operating capacity, suppress a significant increase of inflow of the refrigerant to the operating unit that is under operation from before the variation in the operating capacity, and to suppress the occurrence of accompanying noise by adjusting the opening degree of the predetermined electric valve in the refrigerant circuit RC. The feed-forward control is interrupt control that is executed with higher priority than the ordinary control when the FF control condition is satisfied when the ordinary control is executed in the forward cycle operation.

In the feed-forward control, the device control portion 75 reduces the opening degree of the predetermined electric valve (e.g., 16, 17 or 41) in the refrigerant circuit RC in order to reduce the pressure or the flow rate of the refrigerant flowing through the operating unit that is under operation from before the variation in the operating capacity. As a result, even when the operating capacity varies significantly, inflow of the refrigerant to the operating unit is suppressed from increasing temporarily, particularly in the case of performing the gas-liquid two-phase transfer (namely, in the case in which the opening degree of the indoor expansion valve 41 of the operating unit is larger than that when the liquid transfer is performed). Stated in another way, in the feed-forward control, a decompression ratio of the electric valve, which is a control target, is controlled such that the pressure of the refrigerant at the inlet of the indoor expansion valve 41 in the operating unit, which maintains the operating state from before the feed-forward control is actually executed (namely, from before the variation in the operating capacity), does not significantly change after the variation in the operating capacity. In this embodiment, the second outdoor control valve 17 is selected as the control target in the feed-forward control, and the opening degree of the second outdoor control valve 17 is reduced to a value depending on the situation.

In the FF control table, a range of the opening degree to be reduced is individually defined depending on the magnitude of the varying operating capacity. Thus, the FF control table defines, regarding the electric valve that is the target of the feed-forward control, the decompression ratio and the opening degree after adjustment for each situation.

After the start of execution of the feed-forward control, the device control portion 75 finishes the feed-forward control when a predetermined FF control end condition is satisfied. The FF control end condition is a condition on which it is estimated that a possibility of the significant increase of inflow of the refrigerant to the operating unit is cleared by executing the feed-forward control when the variation in the operating capacity has occurred. The FF control end condition is defined in the FF control table. In this embodiment, the FF control end condition is satisfied when a predetermined time t1 elapses after execution of the feed-forward control. The predetermined time t1 is defined for each situation on the basis of the number of operating units, the number of stopped units, the degree of the variation in the operating capacity, the magnitude of the heat load, the device information, etc. The predetermined time t1 is set to 1 min, for example.

Details of the feed-forward control will be described later in "(5) Details of Feed-Forward Control".

(3-6) Drive Signal Output Portion 76

The drive signal output portion 76 outputs drive signals (drive voltages) to the devices (11, 13, 16, 17, 18, 25, 41, 45, etc.) depending on the nature of control executed by the device control portion 75. The drive signal output portion 76 includes a plurality of inverters (not illustrated) and outputs the drive signal to a particular device (e.g., the compressor 11, the outdoor fan 25, or each indoor fan 45) from the corresponding inverter.

(3-7) Display Control Portion 77

The display control portion 77 is a functional portion controlling operation of each remote controller 60 that serves as a display device. The display control portion 77 outputs predetermined information to the remote controller 60 such that information regarding the operating states and the situations are displayed to a user. During the operation in the ordinary mode, for example, the display control portion 77 displays various items of information, such as the setting temperature, on the remote controller 60.

(4) Processing Flow in Controller 70

Figure 4:
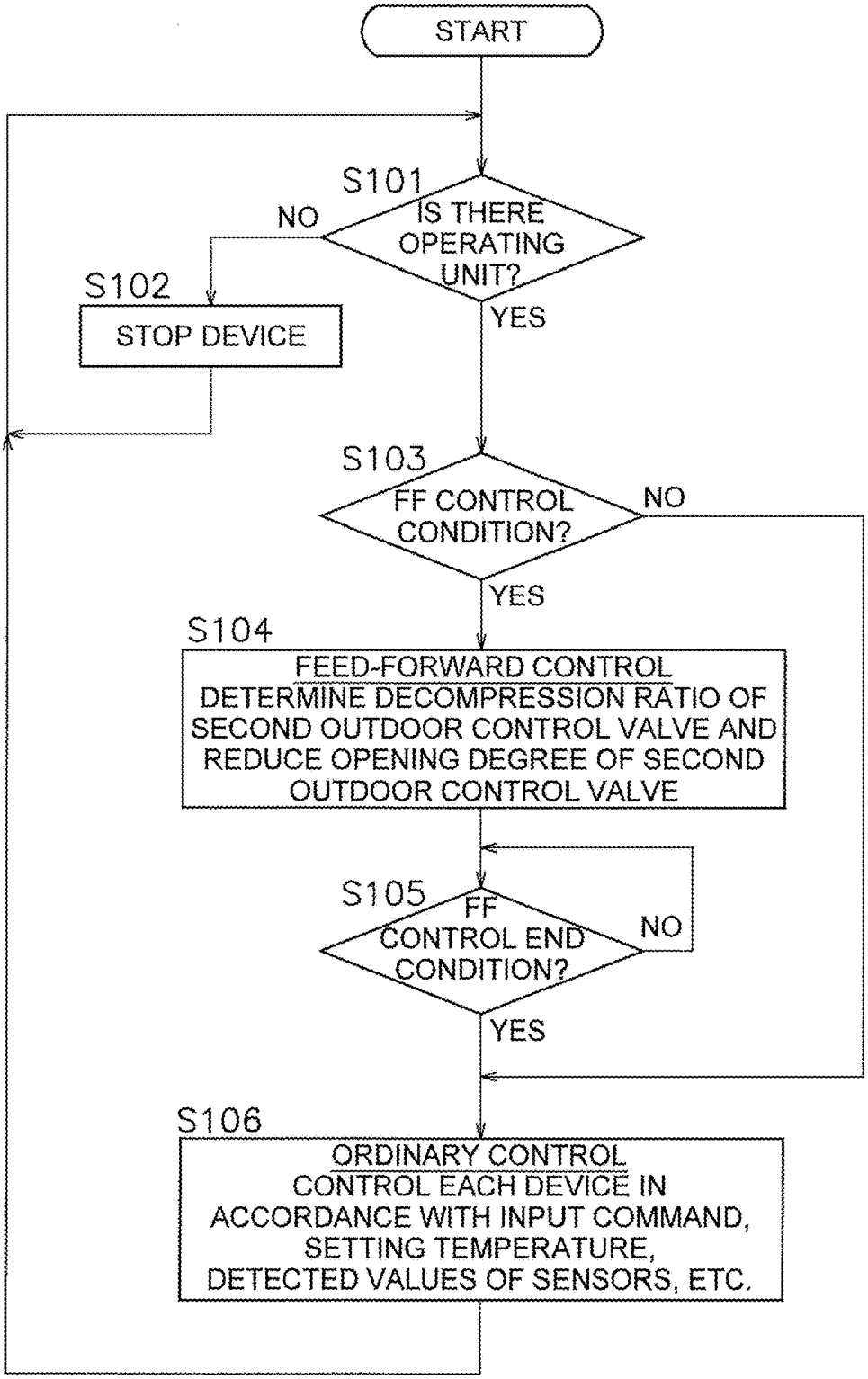
FIG. 4 is a flowchart illustrating an example of a processing flow in the controller.

An example of a processing flow in the controller 70 will be described below with reference to FIG. 4. FIG. 4 is a flowchart illustrating the example of the processing flow in the controller 70. Upon power-on, the controller 70 executes processing in a flow from step S101 to S106 illustrated in FIG. 4. The processing flow illustrated in FIG. 4 is one example and can be modified as appropriate. For example, the order of steps may be changed within the range not causing contradictions. Alternatively, some of the steps may be executed in parallel to some other steps, or one or more other steps may be newly added.

If there is an operating unit in step S101 (namely, if YES), the controller 70 goes to step S103. If there is no operating unit (namely, if NO), the controller 70 goes to step S102.

In step S102, the controller 70 switches each device into a stop state (or maintains the stop state of each device). Then, the controller 70 returns to step S101.

If the FF control condition is not satisfied in step S103 (namely, if the significant variation in the operating capacity does not occur, here if NO), the controller 70 goes to step S106. On the other hand, if the FF control condition is satisfied (namely, if the significant variation in the operating capacity has occurred, here if YES), the controller 70 goes to step S104.

In step S104, the controller 70 executes the feed-forward control. More specifically, in the feed-forward control, the controller 70 determines the decompression ratio of the second outdoor control valve 17 so as to suppress the variation in pressure of the refrigerant, which flows into the operating unit maintaining the operating state, in accordance with the FF control table and the device information depending on the situation, and reduces the opening degree of the second outdoor control valve 17 depending on the decompression ratio. Then, the controller 70 goes to step S105.

If the FF control end condition is not satisfied in step S105 (namely, if it is not estimated that a possibility causing the significant increase of inflow of the refrigerant to the operating unit has been cleared, here if NO), the controller 70 remains in step S105. On the other hand, if the FF control end condition is satisfied (namely, if it is estimated that the possibility causing the significant increase of inflow of the refrigerant to the operating unit has been cleared, here if YES), the controller 70 goes to step S106.

In step S106, the controller 70 executes the ordinary control. More specifically, the controller 70 controls in real time the states of the devices depending on the input command, the setting temperature, the detected values of the sensors (26 and 46), etc., thus performing the forward cycle operation or the reverse cycle operation. Then, the controller 70 returns to step S101.

(5) Details of Feed-Forward Control

In the air conditioning system 100, as described above, when the FF control condition is satisfied during the operation, the feed-forward control is executed by the controller 70 (device control portion 75). The feed-forward control is to suppress an increase of noise caused when passing sounds of the refrigerant increases in the operating unit incidental to the gas-liquid two-phase transfer.

More specifically, when the refrigerant transferred in the liquid-side refrigerant flow path extending between the outdoor unit and the indoor unit is subject to the gas-liquid two-phase transfer in which the refrigerant is transferred in the gas-liquid two-phase state for the purpose of realizing the refrigerant conservation, the opening degree of the indoor expansion valve is usually larger than that when the liquid transfer is performed. Therefore, it is estimated that, when the operating states of the predetermined number or more of operating units vary significantly (namely, when the operating capacity increases or decreases significantly), the flow rate of the refrigerant increases significantly in the indoor unit that maintains the operating state (forward cycle operation) from before the variation in the operating capacity. A possibility of generation of such a situation is high particularly when multiple ones of the indoor units are brought into the operation stop state at the same time. The generation of such a situation may increase the passing sounds of the refrigerant in the indoor units under operation and may cause noise.

In consideration of the above point, when the FF control condition is satisfied (namely, when the operating capacity increases or decreases significantly), the feed-forward control is executed and the opening degree of the predetermined electric valve (here the second outdoor control valve 17) is reduced (namely, the decompression ratio is adjusted) to absorb the variation in the operating capacity, thus reducing the pressure or the flow rate of the refrigerant flowing through the liquid-side connection pipe LC. As a result, the amount of the refrigerant flowing into the operating unit is suppressed from increasing temporarily with the significant variation in the operating capacity. Hence the generation of noise in the operating unit is suppressed when the operating capacity varies significantly.

Figure 5:
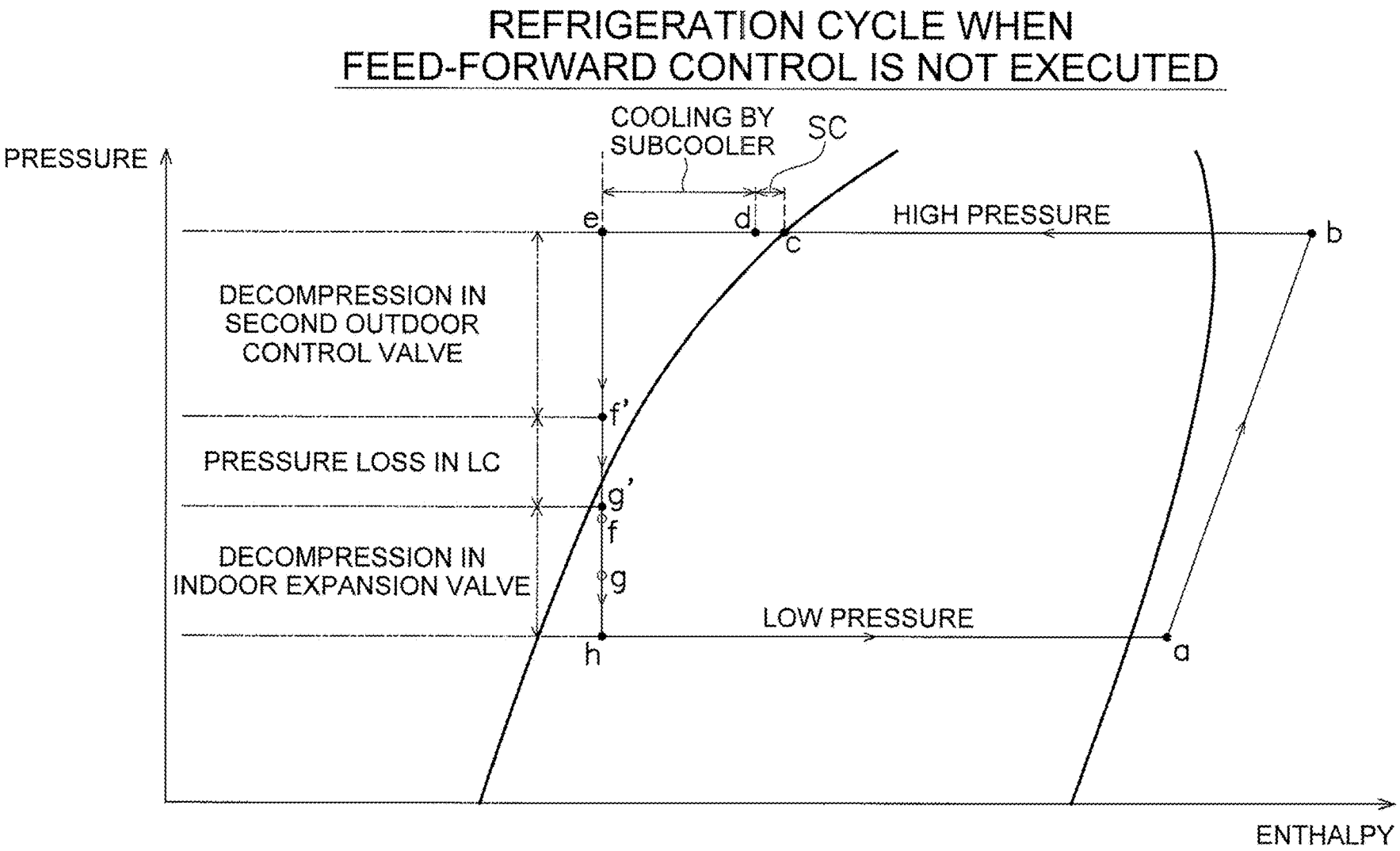
FIG. 5 is a chart illustrating an example of a refrigeration cycle when feed-forward control is not executed upon the occurrence of variation in operating capacity.

FIG. 5 is a chart illustrating an example of the refrigeration cycle when the feed-forward control is not executed upon the occurrence of variation in the operating capacity.

Figure 6:
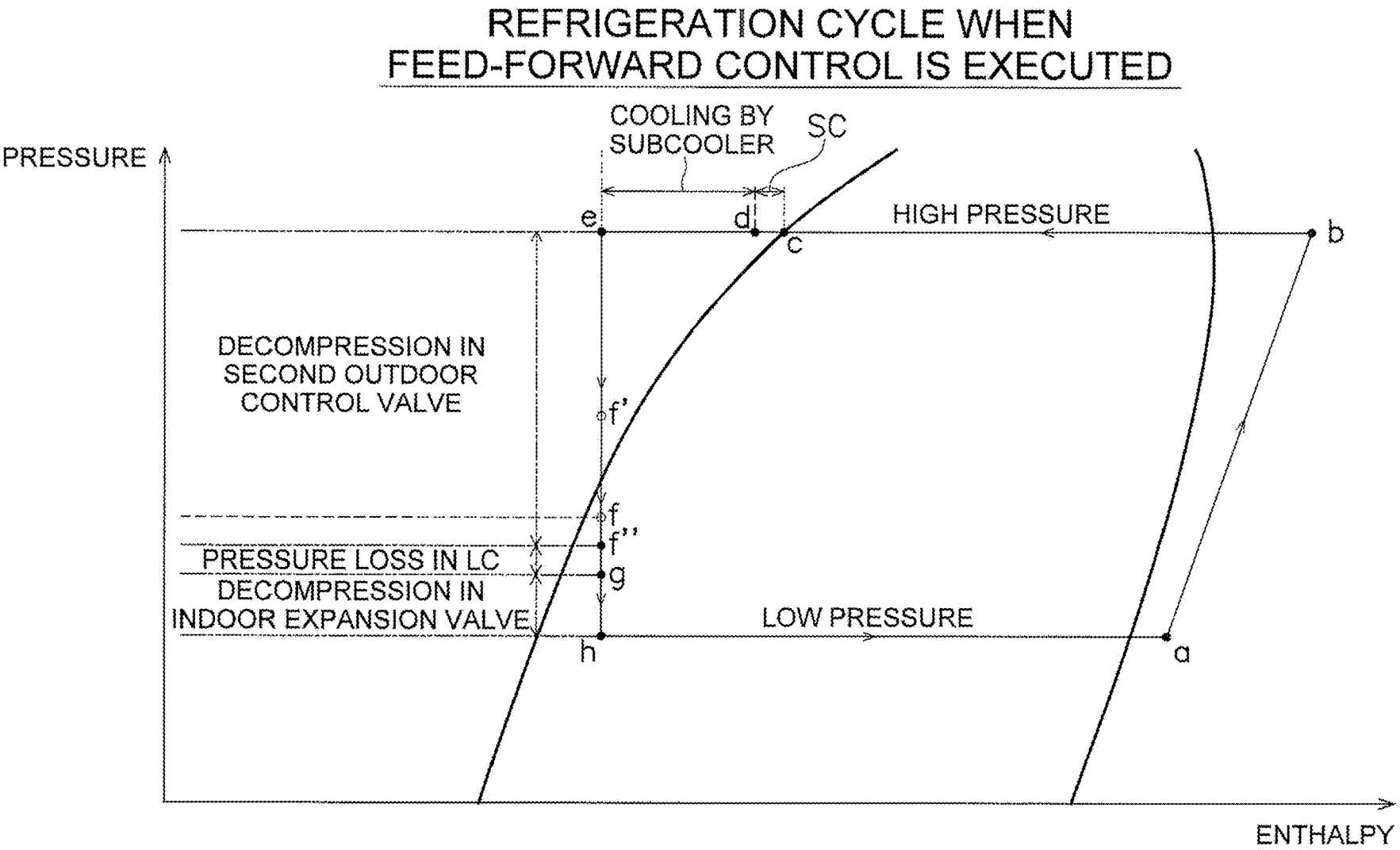
FIG. 6 is a chart illustrating an example of a refrigeration cycle when the feed-forward control is executed upon the occurrence of variation in operating capacity.

FIG. 6 is a chart illustrating an example of the refrigeration cycle when the feed-forward control is executed upon the occurrence of variation in the operating capacity.

As illustrated in FIG. 5, when the feed-forward control is not executed upon the occurrence of significant variation in the operating capacity (i.e., upon the FF control condition being satisfied), the decompression in the second outdoor control valve 17 decreases temporarily (see e-f in FIG. 5). This increases the decompression in the indoor expansion valve 41 of the operating unit maintaining the operating state from before the variation in the operating capacity (see g'-h in FIG. 5). Accordingly, the pressure of the refrigerant flowing into the indoor expansion valve 41 of the operating unit rises, thereby generating noise.

On the other hand, as illustrated in FIG. 6, when the feed-forward control is executed upon the occurrence of significant variation in the operating capacity (i.e., upon the FF control condition being satisfied), the opening degree of the second outdoor control valve 17 is reduced depending on the degree of the variation in the operating capacity, and a decrease of the decompression in the second outdoor control valve 17 is suppressed in comparison with that when the feed-forward control is not executed (FIG. 6 illustrates that the decompression in the second outdoor control valve 17 is larger than that in the case in which the ordinary control is executed; see e-f" in FIG. 6). Thus, the increase of the decompression in the indoor expansion valve 41 of the operating unit maintaining the operating state from before the variation in the operating capacity is suppressed in comparison with that when the feed-forward control is not executed (FIG. 6 illustrates that the decompression in the indoor expansion valve 41 is comparable to that when the ordinary control is executed; see g-h in FIG. 6). Accordingly, the pressure of the refrigerant flowing into the indoor expansion valve 41 of the operating unit is suppressed from rising temporarily, and the generation of noise is suppressed.

Upon the occurrence of significant variation in the operating capacity, for example, a level of sounds in the operating unit when the feed-forward control is not executed is 38 dB (32 dB in the case of the liquid transfer), while a level of sounds in the operating unit when the feed-forward control is executed is reduced to 31 dB.

(6) Features (6-1)

In the air conditioning system 100 according to the above embodiment, when change in the number of operating units is detected by the operating-capacity variation detection portion 74, the controller 70 (device control portion 75) executes the feed-forward control and adjusts the opening degree of the second outdoor control valve 17 in order to suppress the rise of the pressure of the refrigerant flowing into the operating unit in the feed-forward control. Thus, when the number of indoor units 40 under operation is changed, the opening degree of the predetermined electric valve (here the second outdoor control valve 17) is adjusted, and the rise of the pressure of the refrigerant flowing into the operating unit is suppressed. As a result, the increase of noise in the operating unit is suppressed.

(6-2)

In the air conditioning system 100 according to the above embodiment, the refrigerant flowing from the outdoor unit 10 to the indoor unit 40 is transferred in the gas-liquid two-phase state. Thus, even when the operating capacity varies significantly (due to significant change in the operating states of multiple indoor units 40) in the case of the gas-liquid two-phase transfer in which the opening degree of the indoor expansion valve 41 is larger than that in the liquid transfer, the decompression in the indoor expansion valve 41 is suppressed from increasing temporarily. Accordingly, the increase of noise in the operating unit incidental to the gas-liquid two-phase transfer is suppressed.

(6-3)

Furthermore, in the air conditioning system 100 according to the above embodiment, the controller 70 executes the feed-forward control when a decrease of the number of operating units is detected by the operating-capacity variation detection portion 74. When the multiple indoor units 40 are brought into the operation stop state at the same time, the number of rotations of the compressor 11 is adjusted and the opening degree of the second outdoor control valve 17, for example, is adjusted depending on change in the subcooling degree SC with the lapse of time. However, before the system reaches such a state, the amount of refrigerant flowing into the operating unit increases temporarily. In other words, when the multiple indoor units 40 are brought into the operation stop state at the same time, it is estimated with a high probability that the passing sounds of the refrigerant in the indoor unit 40 under operation increases and noise generates. In the air conditioning system 100, however, the generation of noise is suppressed because the controller 70 executes the feed-forward control when the decrease of the number of operating units is detected by the operating-capacity variation detection portion 74.

(6-4)

In the air conditioning system 100 according to the above embodiment, the electric valve of which opening degree is adjusted in the feed-forward control is the second outdoor control valve 17 (first electric valve) functioning to decompress the refrigerant such that the refrigerant flowing from the outdoor unit 10 to the indoor unit 40 passes through the refrigerant connection pipe in the gas-liquid two-phase state. In the feed-forward control, the opening degree of the second outdoor control valve 17 is adjusted and the rise of the pressure of the refrigerant flowing into the operating unit is reliably and simply suppressed. As a result, the increase of noise in the operating unit incidental to the gas-liquid two-phase transfer is high-accurately suppressed while cost reduction is realized.

(7) Modifications

The above embodiment can be appropriately modified as described in the following modifications. Each of the modifications may be implemented in combination with the other modifications within the range not causing contradictions.

(7-1) Modification 1

In the above embodiment, in accordance with the FF control table in which the decompression ratio of the control-target electric valve (second outdoor control valve 17) is defined depending on the magnitude of the varying operating capacity (namely, in which the opening degree thereof is defined for each situation), the controller 70 (device control portion 75) reduces the opening degree of the control-target electric valve in the feed-forward control during the operation.

However, the present disclosure is not always limited to such a case. In the feed-forward control, the controller 70 may determine in real time the decompression ratio of the control-target electric valve in accordance with predetermined information and may control the control-target electric valve to have an opening degree corresponding to the determined decompression ratio. Thus, in the feed-forward control, the controller 70 may calculate the opening degree in real time instead of using the opening degree defined in the FF control table. An example of the case in which the controller 70 calculates the opening degree of the control-target electric valve in real time in the feed-forward control will be described below.

Figure 7:
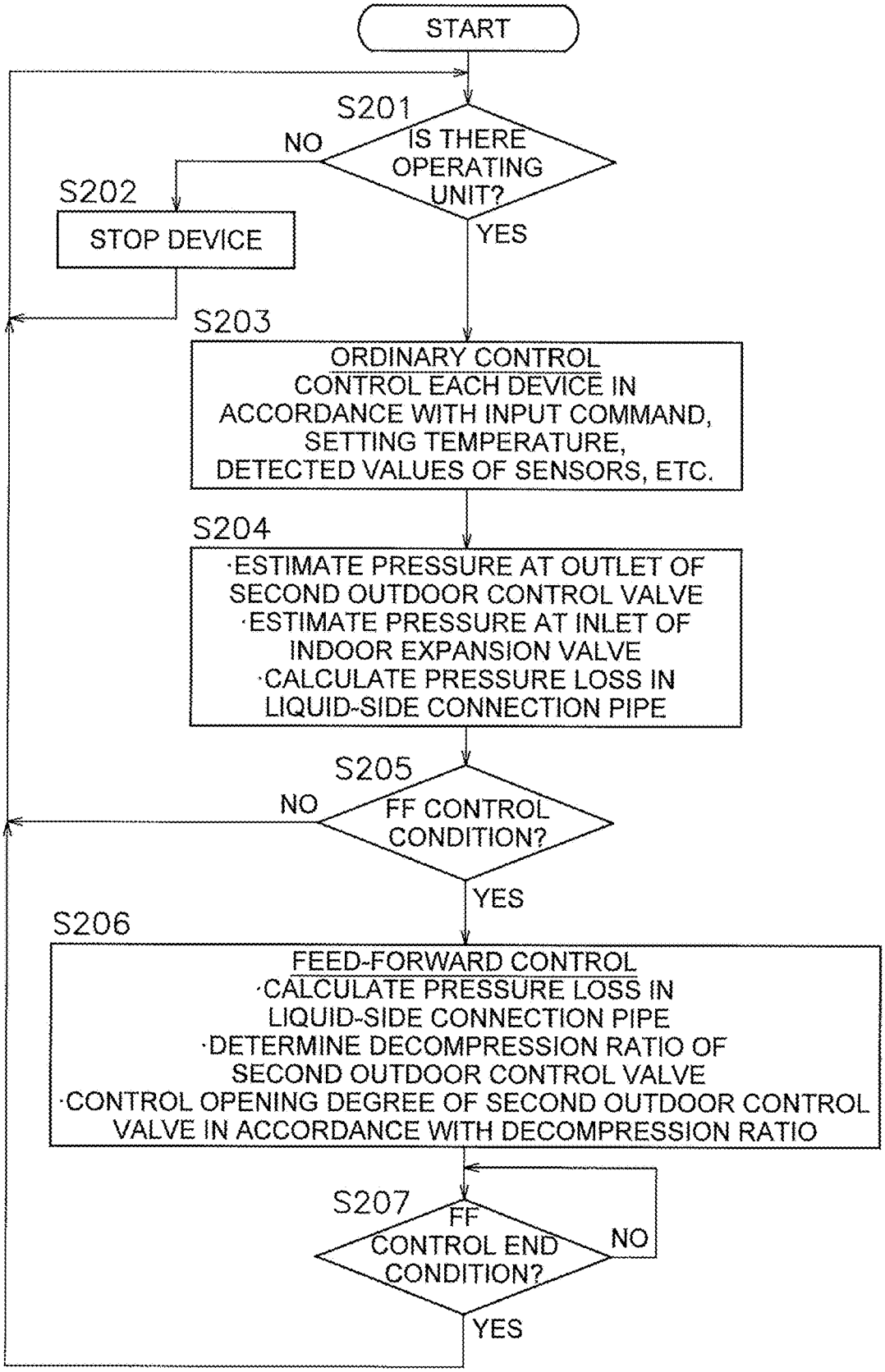
FIG. 7 is a flowchart illustrating an example of a processing flow in the controller when an opening degree of an electric valve as a control target is calculated in real time in the feed-forward control.

For example, the controller 70 executes processing in a flow from step S201 to S207 illustrated in FIG. 7. FIG. 7 is a flowchart illustrating an example of a processing flow in the controller 70 when the opening degree of the electric valve as the control target is calculated in real time in the feed-forward control. The processing flow illustrated in FIG. 7 is one example and can be modified as appropriate. For example, the order of steps may be changed within the range not causing contradictions. Alternatively, some of the steps may be executed in parallel to some other steps, or one or more other steps may be newly added.

If there is an operating unit in step S201 (namely, if YES), the controller 70 goes to step S203. If there is no operating unit (namely, if NO), the controller 70 goes to step S202.

In step S202, the controller 70 switches each device to the stop state (or maintains each device in the stop state). Then, the controller 70 returns to step S201.

In step S203, the controller 70 executes the ordinary control. More specifically, the controller 70 controls in real time the state of each device depending on the input command, the setting temperature, the detected values of the sensors (26 and 46), etc., thus performing the forward cycle operation or the reverse cycle operation. Then, the controller 70 goes to step S204.

In step S204, the controller 70 estimates the pressure (see f in FIG. 2) at the outlet of the second outdoor control valve 17 on the basis of the amount of circulating refrigerant, the opening degree of the second outdoor control valve 17 (Cv value at the current opening degree), the density and pressure at the inlet of the second outdoor control valve 17, etc. The amount of circulating refrigerant is calculated on the basis of the device information (such as the number of rotations of the compressor 11 and the opening degrees of the individual valves), etc. The density at the inlet of the second outdoor control valve 17 is calculated on the basis of the detected values of the outdoor sensors 26 (such as the discharge pressure HP and the refrigerant temperature in the outdoor heat exchanger 14), etc.

Furthermore, the controller 70 estimates the pressure (see g in FIG. 2) at the inlet of the indoor expansion valve 41 on the basis of the evaporation temperature in the indoor heat exchanger 42, the amount of circulating refrigerant in the operating unit, the opening degree of the indoor expansion valve 41 (Cv value at the current opening degree), and the refrigerant density at the outlet of the indoor expansion valve 41. The evaporation temperature in the indoor heat exchanger 42 is calculated from the detected value of the indoor sensor 46 (i.e., the refrigerant temperature in the indoor heat exchanger 42), etc. The amount of circulating refrigerant in the operating unit is calculated from the air conditioning capacity of the operating unit. The refrigerant density at the outlet of the indoor expansion valve 41 is calculated from the refrigerant enthalpy on the output side of the outdoor unit 10 and the evaporation temperature in the indoor unit 40.

Then, the controller 70 calculates a pressure loss ΔP (see f-g in FIG. 2) in the liquid-side connection pipe LC on the basis of the pressure at the outlet of the second outdoor control valve 17, the pressure at the inlet of the indoor expansion valve 41, the detected values of the sensors 26 and 46 (such as the suction pressure LP and the discharge pressure HP), etc.

Calculation of the pressure loss ΔP is facilitated by using the detected value of each sensor 26 or 46, but it may be estimated without using the detected value. For example, the pressure loss ΔP can be estimated from the following formula 1, and cost reduction can be realized with omission of the sensor.

$$\Delta P = \left(\frac{G}{27.09 \times Cv}\right)^2 \left(\frac{1}{den}\right) \quad \text{⟨Math. 1⟩}$$

ΔP . . . pressure loss in the liquid-side connection pipe
G . . . amount of circulating refrigerant
Cv . . . Cv value of the indoor expansion valve
den . . . refrigerant density at the outlet of the indoor expansion valve Then, the controller 70 goes to step S205.

If the FF control condition is not satisfied in step S205 (namely, if the significant variation in the operating capacity does not occur, here if NO), the controller 70 goes back to step S201. On the other hand, if the FF control condition is satisfied (namely, if the significant variation in the operating capacity has occurred, here if YES), the controller 70 goes to step S206.

In step S206, the controller 70 executes the feed-forward control. More specifically, in the feed-forward control, the controller 70 calculates a pressure loss ΔP (see f'-g in FIG. 6) in the liquid-side connection pipe LC after the variation in the operating capacity on the basis of a ratio between the amount of circulating refrigerant before the variation in the operating capacity and the amount of circulating refrigerant after the variation in the operating capacity, etc.

Calculation of the pressure loss ΔP in the liquid-side connection pipe LC after the variation in the operating capacity is also facilitated by using the detected value of each sensor 26 or 46, but it may be estimated without using the detected value. For example, the pressure loss ΔP can be estimated from the following formula 2, and cost reduction can be realized with omission of the sensor.

$$\Delta P = 12.764 \times \frac{G^2 \times l}{d^5 \times den} \quad \text{⟨Math. 2⟩}$$

ΔP . . . pressure loss after the variation in the operating capacity
G . . . amount of circulating refrigerant
L . . . length of the liquid-side connection pipe
D . . . inner diameter of the liquid-side connection pipe
den . . . refrigerant density at the outlet of the indoor expansion valve
(∵ ΔP can be estimated from the amount of circulating refrigerant and the outlet density because the pipe length and the pipe inner diameter do not change)

Then, the controller 70 determines the decompression ratio of the second outdoor control valve 17 on the basis of the calculated pressure loss ΔP, the condensation pressure of the outdoor heat exchanger 14 (see e in FIG. 6), etc. and controls the opening degree of the second outdoor control valve 17 such that the pressure at the inlet of the indoor expansion valve 41 does not change between before and after the variation in the operating capacity.

Thereafter, the controller 70 goes to step S207.

If the FF control end condition is not satisfied in step S207 (namely, if it is not estimated that a possibility causing the significant increase of inflow of the refrigerant to the operating unit has been cleared, here if NO), the controller 70 remains in step S207. On the other hand, if the FF control end condition is satisfied (namely, if it is estimated that the possibility causing the significant increase of inflow of the refrigerant to the operating unit has been cleared, here if YES), the controller 70 returns to step S201.

The foregoing flow from step S201 to S207 can also realize similar advantageous effects to those in the above-described embodiment. In addition, according to this modification, the pressure loss ΔP in the liquid-side connection pipe LC between before and after the variation in the operating capacity is calculated (estimated) in real time, and on the basis of the calculated (estimated) pressure loss, the decompression ratio of the electric valve as the target of the feed-forward control is estimated and the valve opening degree is determined. Therefore, an increase of control accuracy is expected.

(7-2) Modification 2

In the air conditioning system 100, the opening degree of the predetermined electric valve (i.e., the second outdoor control valve 17 in the above embodiment) disposed in the refrigerant circuit RC is reduced in the feed-forward control depending on the degree of the variation in the operating capacity according to the process illustrated in FIG. 6, whereby the increase of the decompression in the indoor expansion valve 41 of the operating unit is suppressed and hence the generation of noise is suppressed.

In the feed-forward control, however, the electric valve undergoing the adjustment of the opening degree is not always limited to the second outdoor control valve 17. Stated in another way, another electric valve may be throttled instead of the second outdoor control valve 17 or in addition to the second outdoor control valve 17 insofar as the increase of the decompression in the indoor expansion valve 41 of the operating unit is suppressed according to the process illustrated in FIG. 6 when the significant variation in the operating capacity has occurred.

For example, the opening degree of the first outdoor control valve 16 (corresponding to a "third electric valve" in claims) may be reduced in the feed-forward control. In another example, the opening degree of the indoor expansion valve 41 (corresponding to a "second electric valve" in claims) may be reduced in the feed-forward control. In still another example, another electric valve not disclosed in FIG. 1 may be disposed in the refrigerant circuit RC (particularly, in the flow path connected to the liquid side of the outdoor heat exchanger 14), and the opening degree of the other electric valve may be reduced in the feed-forward control. In those examples as well, the rise of pressure of the refrigerant flowing into the operating unit maintaining the operating state from before the variation in the operating capacity can be suppressed, and similar advantageous effects to those in the above embodiment can be realized.

In the feed-forward control executed in the above cases, any one of the electric valves may be alternatively controlled, or the plurality of electric valves may be controlled together. Moreover, in the above cases, the second outdoor control valve 17 is not always required and may be omitted as appropriate. For example, another means (e.g., a decompression mechanism such as a capillary tube) for realizing the gas-liquid two-phase transfer may be disposed instead of the second outdoor control valve 17.

(7-3) Modification 3

The above embodiment has been described in connection with the case in which, when the number of operating units increases or decreases by the predetermined number (e.g., two) for the predetermined period Pt during the forward cycle operation, the FF control condition is satisfied and the feed-forward control is executed. However, the FF control condition is not always limited to that case and it may be modified as appropriate.

For example, the FF control condition may be determined to be satisfied when the system comes into a particular first state (i.e., a state in which a total value of the air conditioning capacities of the indoor units 40 having been subject to change of the operating state is a predetermined reference value SV or more) on condition that the number of operating units has increased or decreased by the predetermined number (e.g., two) or more for the predetermined period Pt. More specifically, the FF control condition may be determined to be satisfied when the total value of the air conditioning capacities of the indoor units 40 having been subject to change of the operating state (i.e., of the indoor units 40 having been brought into the operation stop state from the operating state) is a first predetermined reference value SV1 or more on condition that the number of operating units has decreased by the predetermined number or more. In addition, the FF control condition may be determined to be satisfied when the total value of the air conditioning capacities of the indoor units 40 having been subject to change of the operating state (i.e., of the indoor units 40 having been brought into the operating state from the operation stop state) is a second predetermined reference value SV2 or more on condition that the number of operating units has increased by the predetermined number or more.

In the above cases, the operating-capacity variation detection portion 74 may specify, from the device information, the indoor units 40 having been subject to change (start/stop) of the operating state, and may calculate the total value of the air conditioning capacities of the specified indoor units 40 on the basis of the capacity information. When the calculated value is the first reference value SV1 or the second reference value SV2 or more, the operating-capacity variation detection portion 74 may determine that the significant variation has occurred in the operating capacity of the air conditioning system 100, and then may set the FF control flag M9.

The first reference value SV1 and the second reference value SV2 are each a value at which it is estimated that the variation in the operating capacity occurs at such a level as probably causing the increase of noise incidental to the gas-liquid two-phase transfer in the operating unit maintaining the operating state, and it is set as appropriate depending on the design specifications and the installation environments. The first reference value SV1 and the second reference value SV2 may be set to the same value or different values. For example, the first reference value SV1 and the second reference value SV2 are each set to 5.0 (Kw) (though not always limited to that value).

In the case of the FF control condition being set as described above, the feed-forward control is executed when the system comes into a particular first state (i.e., a state in which the total value of the air conditioning capacities of the indoor units 40 having been subject to change of the operating state is the reference value or more) on condition that the number of operating units has increased or decreased by a predetermined number (e.g., two) or more for the predetermined period Pt. Accordingly, the first control can be executed in the first state in which the operating capacity in the entire system varies significantly (i.e., the state in which execution of the first control is highly demanded). As a result, the increase of noise incidental to the gas-liquid two-phase transfer can be reliably suppressed in the operating unit.

(7-4) Modification 4

The application of the FF control condition is not always limited to the case in which the forward cycle operation is performed, and whether the FF control condition is satisfied or not may be determined on other types of operations in which the gas-liquid two-phase transfer is performed.

(7-5) Modification 5

The above embodiment has been described, by way of example, in connection with the case in which the predetermined period Pt is set to 30 sec. However, the predetermined period Pt is not always limited to 30 sec, and it may be longer or shorter than 30 sec. For example, the predetermined period Pt may be set to 1 min or 15 sec.

Furthermore, the above embodiment has been described, by way of example, in connection with the case in which the predetermined time t1 is set to 1 min. However, the predetermined time t1 is not always limited to 1 min, and it may be longer or shorter than 1 min. For example, the predetermined time t1 may be set to 3 min or 30 sec.

(7-6) Modification 6

The configuration of the refrigerant circuit RC in the above embodiment is not always limited to that illustrated in FIG. 1, and it may be modified as appropriate depending on the design specifications and the installation environments.

For example, the first outdoor control valve 16 is not always required, and it may be omitted as appropriate. In that case, the second outdoor control valve 17 may be given with the function of the first outdoor control valve 16 in the reverse cycle operation.

As another example, the second outdoor control valve 17 is not always required to be disposed within the outdoor unit 10, and it may be disposed outside the outdoor unit 10 (e.g., in the liquid-side connection pipe LC).

As still another example, the indoor expansion valve 41 is not always required to be disposed within the indoor unit 40, and it may be disposed outside the indoor unit 40 (e.g., in the liquid-side connection pipe LC).

As still another example, the subcooler 15 and the third outdoor control valve 18 are not always required, and they may be omitted as appropriate. A device not illustrated in FIG. 1 may be newly added.

As still another example, a refrigerant flow path switching unit for switching the refrigerant flow toward each indoor unit 40 may be disposed in the refrigerant circuit RC between the outdoor unit 10 and each indoor unit 40 such that the forward cycle operation and the reverse cycle operation can be individually performed for each indoor unit 40. In that case, the determination on whether the FF control condition is satisfied may be made not only in a state in which the indoor unit 40 is under the forward cycle operation, but also in a state in which the indoor unit 40 performing the forward cycle operation (cooling operation) and the indoor unit 40 performing the reverse cycle operation (heating operation) are both present. Furthermore, in the above case, the electric valve as the control target in the feed-forward control may be disposed in the refrigerant flow path switching unit.

(7-7) Modification 7

In the air conditioning system 100 according to the above embodiment, the controller 70 (device control portion 75) ends the feed-forward control when the predetermined FF control end condition is satisfied after the start of execution of the feed-forward control, and the FF control end condition is determined to be satisfied upon the lapse of the predetermined time t1 after the end of execution of the feed-forward control. However, the FF control end condition is not always limited to the above-described condition, and whether the FF control condition is satisfied may be determined in accordance with another type of event. For example, whether the FF control condition is satisfied may be determined in accordance with the detected value of each sensor 26 or 46, which is stored in the detected value storage area M2, the device information stored in the device information storage area M3, and/or the input command stored in the command storage area M4, etc.

(7-8) Modification 8

In the air conditioning system 100 according to the above embodiment, the plurality (four or more) of indoor units 40 are connected in series or parallel to one outdoor unit 10 through the connection pipes (GC and LC). However, the numbers and connection forms of the outdoor unit 10 and/or the indoor units 40 can be modified as appropriate depending on the installation environments and the design specifications. For example, the plurality of outdoor units 10 may be arranged in series or parallel. Alternatively, only one indoor unit 40 may be connected to one outdoor unit 10.

(7-9) Modification 9

In the above embodiment, the controller 70 controlling the operation of the air conditioning system 100 is constituted by connecting the outdoor unit controller 30 and the indoor unit controllers 48 in the individual indoor unit 40 via the communication lines. However, the configuration of the controller 70 is not always limited to that example, and it may be modified as appropriate depending on the design specifications and the installation environments. In other words, the configuration of the controller 70 is not limited to particular one insofar as the elements (71 to 77) included in the controller 70 are realized. Thus, some or all of the elements (71 to 77) included in the controller 70 are not always required to be disposed in any of the outdoor unit 10 and the indoor units 40, and may be disposed in another device or independently.

For example, the controller 70 may be constituted by another device, such as the remote controller 60 or a concentrated management device, in combination with or instead of one or both of the outdoor unit controller 30 and the indoor unit controller 48. In that case, the other device may be disposed in a remote place and connected to the outdoor unit 10 or the indoor units 40 via a communication network.

In another example, the controller 70 may be constituted by only the outdoor unit controller 30.

(7-10) Modification 10

In the above embodiment, R32 is used as the refrigerant circulating in the refrigerant circuit RC. However, the refrigerant used in the refrigerant circuit RC is not limited to particular one and may be another type of refrigerant. For example, an HFC refrigerant, such as R407C or R410A, may be used in the refrigerant circuit RC.

(7-11) Modification 11

In the above embodiment, the concept of the present disclosure is applied to the air conditioning system 100. However, the concept of the present disclosure can be further applied, without being limited to the above case, to another type of refrigeration apparatus (such as a hot water supply apparatus or a heat pump chiller) including the refrigerant circuit.

(7-12) Modification 12

In the above embodiment, the concept of the present disclosure is applied to the air conditioning system 100 in which the gas-liquid two-phase transfer is performed. Thus, the concept of the present disclosure is mainly intended to suppress the rise of pressure of the refrigerant flowing into the operating unit and to suppress the generation of noise when the significant variation in the operating capacity has occurred in the situation where the gas-liquid two-phase transfer is performed (i.e., where the opening degree of the indoor expansion valve 41 in the operating unit is set larger than that in the case of performing the liquid transfer).

However, application of the concept of the present disclosure is not necessarily excluded for an air conditioning system in which the liquid transfer is performed. Thus, the concept of the present disclosure can be of course applied to the air conditioning system performing the liquid transfer because a similar problem may also occur in that type of air conditioning system due to the significant variation in the operating capacity (although the seriousness of the problem is not so great as in the system performing the gas-liquid two-phase transfer). Stated in another way, also in the liquid transfer in which the refrigerant flowing through the liquid-side connection pipe LC is in the liquid state, noise may generate because the variation in pressure of the refrigerant flowing into the operating unit occurs due to the variation in the operating capacity (namely, because the pressure of the refrigerant flowing into the operating unit increases particularly with the increase of the number of operating units). However, the generation of noise can be suppressed by executing similar control to the above-described feed-forward control. When the liquid transfer is performed, the second outdoor control valve 17 may not be disposed in the refrigerant circuit RC. In such a case, the opening degree of one or more other predetermined valves (e.g., the first outdoor control valve 16 and/or the indoor expansion valve 41) may be controlled in the feed-forward control.

(8)

While the embodiment has been described above, it is to be understood that the disclosed embodiment and detailed matters can be variously modified without departing from the gist and the scope defined in claims.

INDUSTRIAL APPLICABILITY

The present disclosure can be applied to air conditioning systems.

REFERENCE SIGNS LIST

10: outdoor unit
11: compressor
12: accumulator
13: four-way switching valve
14: outdoor heat exchanger
15: subcooler
16: first outdoor control valve (electric valve, third electric valve)
17: second outdoor control valve (electric valve, first electric valve)
18: third outdoor control valve
19: liquid-side shutoff valve
20: gas-side shutoff valve
25: outdoor fan
26: outdoor sensor
30: outdoor unit controller
40 (40*a*, 40*b*, 40*c*, 40*d*): indoor unit
41: indoor expansion valve (electric valve, second electric valve)
42: indoor heat exchanger
45: indoor fan
46: indoor sensor
48: indoor unit controller
60: remote controller
70: controller (detection portion, control portion)
71: storage portion
72: input control portion
73: mode control portion
74: operating-capacity variation detection portion (detection portion)
75: device control portion (control portion)
76: drive signal output portion
77: display control portion
100: air conditioning system
151: main flow path
152: sub-flow path
GC (G1, G2, etc.): gas-side connection pipe
LC (L1, L2, etc.): liquid-side connection pipe
M1: program storage area
M2: detected value storage area
M3: device information storage area
M4: command storage area
M5: ordinary control storage area
M6: FF control condition storage area
M7: FF control storage area
M8: control mode identification flag
M9: FF control flag
P1 to P14: first pipe to fourteenth pipe
RC: refrigerant circuit

CITATION LIST

Patent Literature

<Patent Literature 1> International Publication No. 2015/029160

The invention claimed is:

1. An air conditioning system performing a refrigeration cycle in a refrigerant circuit including an outdoor unit, a plurality of indoor units, a refrigerant connection pipe connecting the outdoor unit and the indoor units, the air conditioning system comprising:

an electric valve decompressing a refrigerant flowing in the refrigerant circuit in accordance with an opening degree;

a detector for detecting a change of the number of operating units that are the indoor units under operation; and a controller for controlling a state of the electric valve, wherein the controller executes a first control when a change of the number of operating units is detected by the detector, and adjusts the opening degree of the electric valve in the first control to suppress a rise of pressure of the refrigerant flowing into an operating unit, when the change of the number of operating units is detected by the detector, the controller executes the first control on condition of the system being in a first state in which a total value of air conditioning capacities of the indoor units having been subject to change of an operating state is a predetermined reference value or more, and the reference value is a value at which an occurrence of variation in an operating capacity of the system is estimated at a level that causes an increase of noise in the operating unit.

2. The air conditioning system according to claim 1, wherein the refrigerant flowing from the outdoor unit to the indoor units is transferred in a gas-liquid two-phase state.

3. The air conditioning system according to claim 1, wherein the controller executes the first control when a decrease of the number of operating units is detected by the detector.

4. The air conditioning system according to claim 1, further comprising a storage for storing capacity information that specifies an air conditioning capacity of each of the indoor units.

5. The air conditioning system according to claim 1, wherein the electric valve is a first electric valve decompressing the refrigerant such that the refrigerant flowing from the outdoor unit to the indoor units passes through the refrigerant connection pipe in the gas-liquid two-phase state, and the controller reduces an opening degree of the first electric valve in the first control.

6. The air conditioning system according to claim 1, wherein the electric valve decompresses the refrigerant that flows from the refrigerant connection pipe to a corresponding indoor unit, and the controller reduces an opening degree of the electric valve in the first control.

7. The air conditioning system according to claim 1, further comprising an outdoor heat exchanger disposed in the outdoor unit and functioning as a condenser or a radiator for the refrigerant, wherein the electric valve is disposed between the outdoor heat exchanger and the refrigerant connection pipe, and the controller reduces an opening degree of the electric valve in the first control.

* * * * *